US007931511B2

(12) United States Patent
Suzuki et al.

(10) Patent No.: US 7,931,511 B2
(45) **Date of Patent: *Apr. 26, 2011**

(54) BOAT PROPULSION SYSTEM

(75) Inventors: Takayoshi Suzuki, Shizuoka (JP); Daisuke Nakamura, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 30 days.

This patent is subject to a terminal disclaimer.

(21) Appl. No.: 12/398,215

(22) Filed: Mar. 5, 2009

(65) Prior Publication Data

US 2009/0227160 A1 Sep. 10, 2009

(30) Foreign Application Priority Data

Mar. 6, 2008 (JP) ..... 2008-056739

(51) Int. Cl.
*B63H 21/22* (2006.01)

(52) U.S. Cl. ..... 440/1; 440/84; 440/86

(58) Field of Classification Search ..... 440/1, 84, 440/86

See application file for complete search history.

(56) References Cited

U.S. PATENT DOCUMENTS 5,148,721 A * 9/1992 Anan et al. ..... 701/53
5,711,742 A * 1/1998 Leinonen et al. ..... 477/121
5,888,108 A 3/1999 Iriono
2008/0179126 A1* 7/2008 Unno et al. ..... 180/230
2009/0209144 A1* 8/2009 Suzuki et al. ..... 440/1
2009/0209145 A1* 8/2009 Suzuki et al. ..... 440/1
2009/0209151 A1* 8/2009 Suzuki et al. ..... 440/86
2009/0215329 A1* 8/2009 Suzuki et al. ..... 440/1
2009/0215330 A1* 8/2009 Suzuki et al. ..... 440/1
2009/0221193 A1* 9/2009 Suzuki et al. ..... 440/1
2009/0227160 A1* 9/2009 Suzuki et al. ..... 440/86

FOREIGN PATENT DOCUMENTS

JP 09-263294 A 10/1997

* cited by examiner

*Primary Examiner* — Stephen Avila

(74) *Attorney, Agent, or Firm* — Keating & Bennett, LLP

(57) ABSTRACT

A boat propulsion system includes a gear shift mechanism arranged to transmit a driving force generated by an engine to first and second propellers at one of at least a low speed reduction ratio and a high speed reduction ratio, and a control section arranged to perform control so as to shift a speed reduction ratio of the gear shift mechanism based on first and second gear shift control maps when an acceleration command from a user is detected. The first and second gear shift control maps define a region to shift the speed reduction ratio of the gear shift mechanism using two parameters, preferably a rotational speed of the engine and a lever opening degree of a lever of a control lever portion. The boat propulsion system achieves both the acceleration performance and the maximum speed desired by a user.

12 Claims, 14 Drawing Sheets

BOAT PROPULSION SYSTEM

BACKGROUND OF THE INVENTION

1. Field of the Invention

The present inventions relates to a boat propulsion system, and more specifically to a boat propulsion system including an engine.

2. Description of the Related Art

A boat propulsion unit including an engine is conventionally known (see JP-A-Hei 9-263294, for example). JP-A-Hei 9-263294 discloses a boat propulsion unit including an engine and a power transmission mechanism for transmitting a driving force of the engine to a propeller at a certain fixed speed reduction ratio. In the boat propulsion unit, the driving force of the engine is directly transmitted to the propeller via the power transmission mechanism so that the propeller speed increases in proportion to the engine speed as the engine speed increases.

However, the boat propulsion unit (boat propulsion system) disclosed in JP-A-Hei 9-263294 has a disadvantage in that it is difficult to improve the acceleration performance at a low speed in the case where the speed reduction ratio of the power transmission mechanism is set so as to increase the maximum speed. In contrast, in the case where the speed reduction ratio of the power transmission mechanism is set so as to improve the acceleration performance at low speed, it is disadvantageously difficult to increase the maximum speed. That is, the boat propulsion unit disclosed in JP-A-Hei 9-263294 has a problem in that it is difficult to achieve both the acceleration performance and the maximum speed desired by a user.

SUMMARY OF THE INVENTION

In order to overcome the problems described above, preferred embodiments of the present invention provide a boat propulsion system that can achieve both the acceleration performance and the maximum speed desired by a user.

According to a preferred embodiment of the present invention, a boat propulsion system includes an engine, a propeller driven by the engine, an acceleration detection section arranged to detect an acceleration command from a user, a gear shift mechanism arranged to transmit a driving force generated by the engine to the propeller at one of at least a low speed reduction ratio and a high speed reduction ratio, and a control section arranged to perform control so as to shift a speed reduction ratio of the gear shift mechanism based on a gear shift control map in the case where the acceleration detection section detects an acceleration command from the user, wherein the gear shift control map represents a region to shift the speed reduction ratio of the gear shift mechanism using a plurality of parameters.

As described above, the boat propulsion system according to a preferred embodiment of the present invention is provided with a gear shift mechanism arranged to transmit a driving force generated by the engine to the propeller at one of at least a low speed reduction ratio and a high speed reduction ratio. Consequently, the acceleration performance at a low speed can be improved by allowing the gear shift mechanism to transmit the driving force generated by the engine to the propeller at the low speed reduction ratio. Meanwhile, the maximum speed can be increased by allowing the gear shift mechanism to transmit the driving force generated by the engine to the propeller at the high speed reduction ratio. As a result, it is possible to substantially provide both the acceleration performance and the maximum speed desired by the user.

The boat propulsion system according to a preferred embodiment of the present invention is also provided with a control section arranged to perform control so as to shift a speed reduction ratio of the gear shift mechanism based on a gear shift control map, which represents a region to shift the speed reduction ratio of the gear shift mechanism using a plurality of parameters, in the case where the acceleration detection section detects an acceleration command from the user. Therefore, the control section can perform control so as to shift the speed reduction ratio according to the acceleration command from the user more appropriately by virtue of using the plurality of parameters, compared to the case where the speed reduction ratio of the gear shift mechanism is shifted based on a certain threshold of one parameter without using the gear shift control map.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Hereinafter, description will be made of preferred embodiments of the present invention with reference to the drawings.

Figure 1:
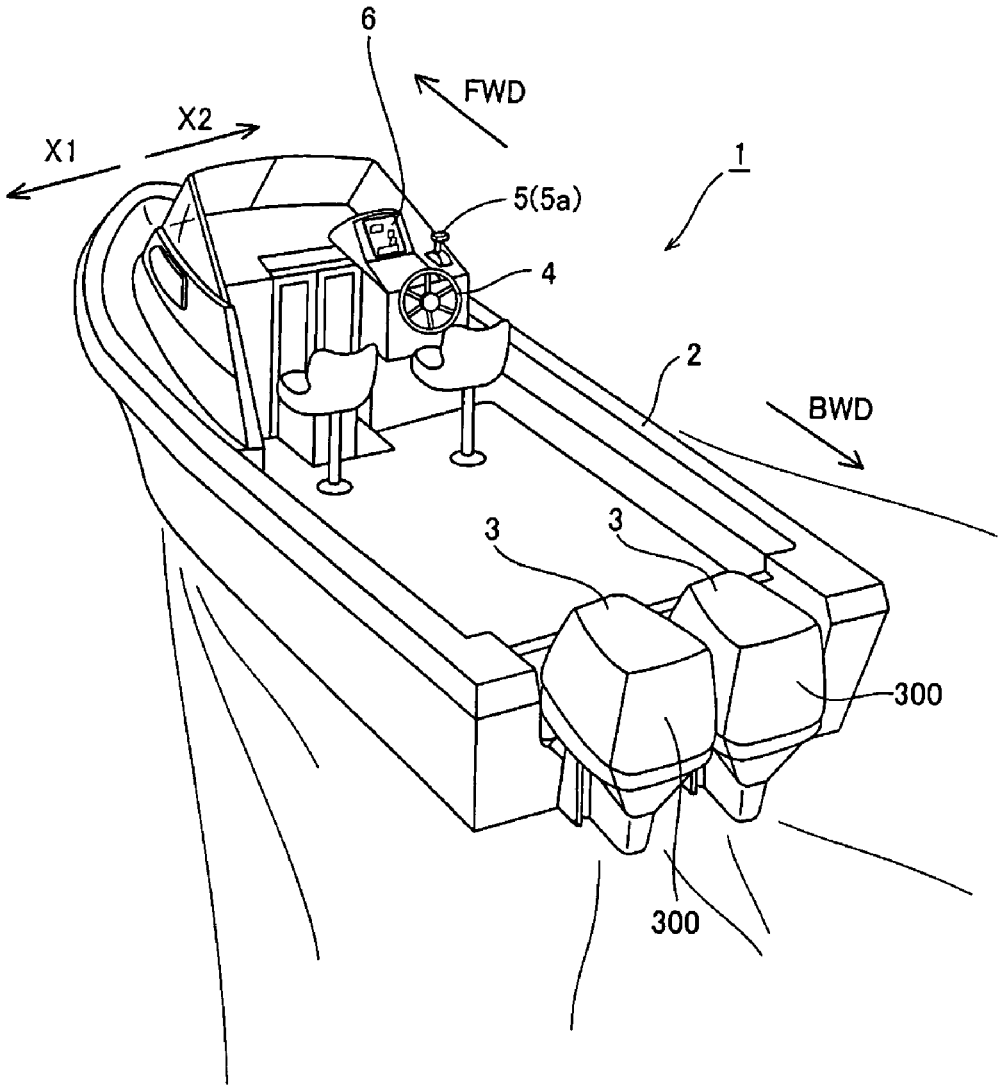
FIG. 1 is a perspective view showing a boat equipped with a boat propulsion system in accordance with a preferred embodiment of the present invention.
Figure 2:
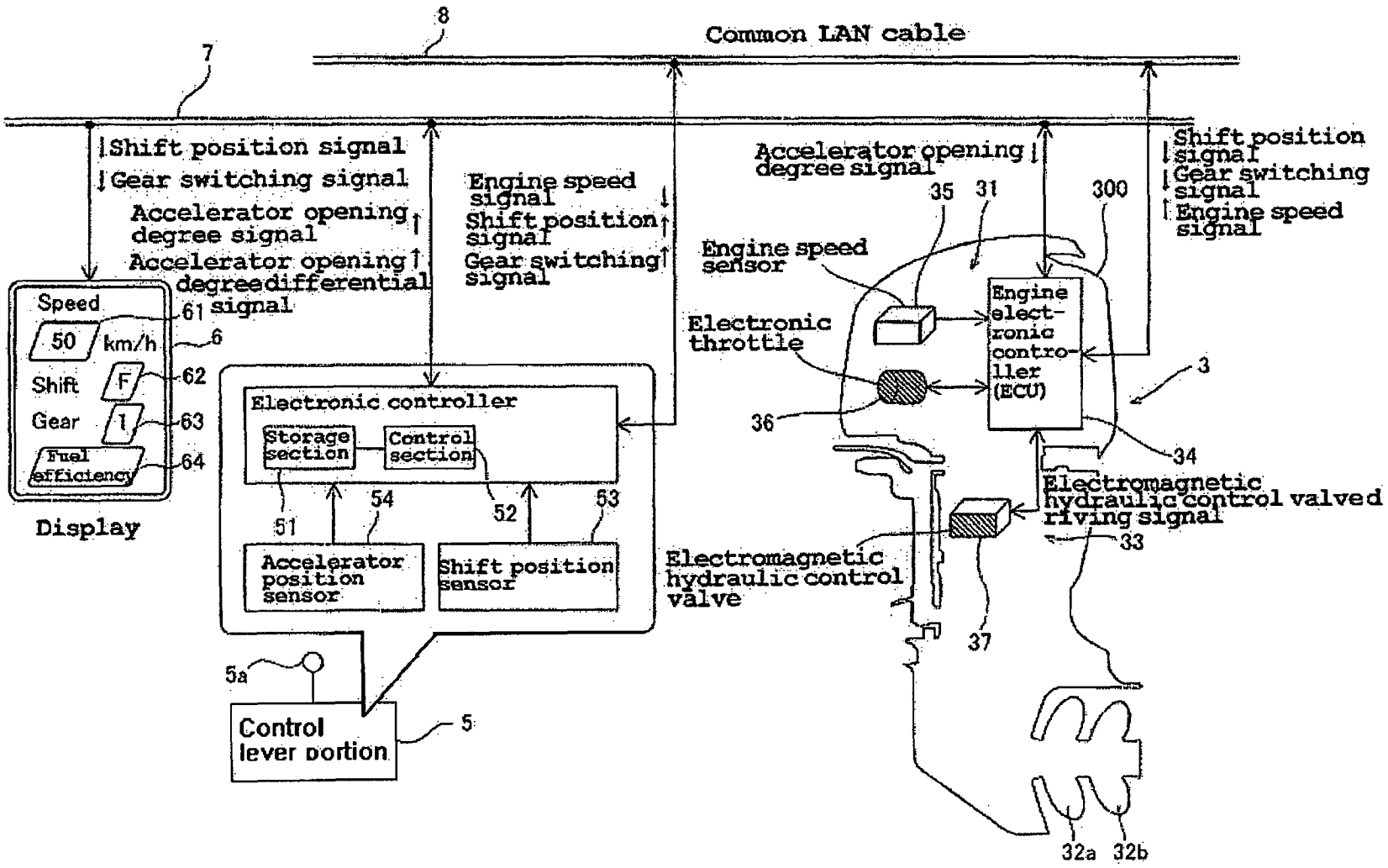
FIG. 2 is a block diagram showing the configuration of the boat propulsion system in accordance with a preferred embodiment of the present invention.

FIG. 1 is a perspective view showing a boat equipped with a boat propulsion system in accordance with a preferred embodiment of the present invention. FIG. 2 is a block diagram showing the configuration of the boat propulsion system in accordance with a preferred embodiment of the present invention. FIGS. 3 to 7 each illustrate the detailed configuration of the boat propulsion system in accordance with a preferred embodiment shown in FIG. 1. In the drawings, FWD denotes the forward direction of the boat while BWD denotes the backward direction of the boat. First, a description will be made of the configuration of the boat 1 and the boat propulsion system provided in the boat 1 in accordance with a preferred embodiment with reference to FIGS. 1 to 7.

As shown in FIG. 1, the boat 1 in accordance with a preferred embodiment is provided with a hull 2 that floats on the water surface, two outboard motors 3 attached to the stern of the hull 2 to propel the hull 2, a steering portion 4 arranged to steer the hull 2, a control lever portion 5 disposed in the vicinity of the steering portion 4 and including a lever 5*a* that is movable in the fore-and-aft direction, and a display 6 disposed in the vicinity of the control lever portion 5. As shown in FIG. 2, the outboardmotors 3, the control lever portion 5, and the display 6 are connected to each other preferably via a common LAN cable 7 and a common LAN cable 8, for example. The boat propulsion system includes the outboard motor 3, the steering portion 4, the control lever portion 5, the display 6, the common LAN cable 7, and the common LAN cable 8.

As shown in FIG. 1, the two outboard motors 3 are preferably disposed symmetrically with respect to the center in the width direction of the hull 2 (the direction of the arrow X1 and the direction of the arrow X2). Each outboard motor 3 is covered with a case 300. The case 300 is preferably formed of a resin or the like, and protects the inside of the outboard motor 3 from water or the like. The outboard motor 3 includes an engine 31, two propellers 32*a* and 32*b* (see FIG. 4) arranged to convert a driving force of the engine 31 into thrust for the boat 1, a gear shift mechanism 33 arranged to transmit the driving force generated by the engine 31 to the propellers 32*a* and 32*b* at one of a low speed reduction ratio (approximately 1.33:1.00) and a high speed reduction ratio (approximately 1.0:1.0), and an ECU (engine electronic controller) 34 arranged to electrically control the engine 31 and the gear shift mechanism 33. The ECU 34 is an example of the "control section" of a preferred embodiment of the present invention. To the ECU 34 are connected an engine speed sensor 35 arranged to detect the rotational speed of the engine 31 and an electronic throttle 36 arranged to control the throttle opening degree of a throttle (not shown) of the engine 31 based on an accelerator opening degree signal to be discussed below. The engine speed sensor 35 is disposed in the vicinity of a crankshaft 301 (see FIG. 4) of the engine 31, and detects the rotational speed of the crankshaft 301 and transmits the detected rotational speed of the crankshaft 301 to the ECU 34. The rotational speed of the crankshaft 301 in the present preferred embodiment is an example of the "engine speed." The electronic throttle 36 not only controls the throttle opening degree of the throttle (not shown) of the engine 31 based on the accelerator opening degree signal from the ECU 34 but also transmits the throttle opening degree to the ECU 34 and a control section 52 to be discussed below.

In the present preferred embodiment, the ECU 34 generates an electromagnetic hydraulic control valve driving signal based on a gear switching signal and a shift position signal sent from the control section 52 of the control lever portion 5 to be discussed below. An electromagnetic hydraulic control valve 37 is connected to the ECU 34. The ECU 34 performs a control so as to send an electromagnetic hydraulic control valve driving signal to the electromagnetic hydraulic control valve 37. The gear shift mechanism 33 is controlled by driving the electromagnetic hydraulic control valve 37 based on the electromagnetic hydraulic control valve driving signal. The configuration and operation of the gear shift mechanism 33 will be described in detail below.

In the present preferred embodiment, the control lever portion 5 preferably includes, built therein, a storage section 51 arranged to store a gear shift control map and a mode selection map to be discussed below, and the control section 52 arranged to generate an electronic signal (gear switching signal, shift position signal, accelerator opening degree signal, and accelerator opening degree differential signal) to be sent to the ECU 34. The control lever portion 5 preferably further includes, built therein, a shift position sensor 53 arranged to detect the shift position of the lever 5*a*, and an accelerator position sensor 54 arranged to sense the accelerator opening degree (lever opening degree) that is variable by operating the lever 5*a*. The shift position sensor 53 is arranged to detect, which of a neutral position, a position in front of the neutral position, and a position in the rear of the neutral position, the shift position that the lever 5*a* is in. The storage section 51 and the control section 52 are connected to each other. The control section 52 can read the gear shift control map and the mode selection map stored in the storage section 51. The control section 52 is connected to both the shift position sensor 53 and the accelerator position sensor 54. This enables the control section 52 to acquire a detection signal (shift position signal) detected by the shift position sensor 53 and converted into an electronic signal and an accelerator opening degree signal sensed by the accelerator position sensor 54 and converted into an electronic signal.

The control section 52 calculates an accelerator opening degree differential based on the accelerator opening degree signal detected by the accelerator position sensor 54. The accelerator opening degree differential is calculated by the control section 52 by differentiating the accelerator opening degree quantified by the accelerator position sensor 54 with respect to time. That is, the accelerator opening degree differential is equivalent to the operation speed of the lever 5*a* of the control lever portion 5 turned by a user (boat operator) in the fore-and-aft direction (the direction of the arrow FWD and the direction of the arrow BWD in FIG. 3). This enables the control section 52 to detect an acceleration command from the user based on the accelerator opening degree differential. For example, in the case where the user abruptly turns the lever 5*a* (see FIG. 3) in the direction of the arrow FWD (see FIG. 3), the variation amount per unit time of the opening degree of the lever 5*a* of the control lever portion 5, namely the accelerator opening degree differential, is large. On the other hand, in the case where the lever 5*a* (see FIG. 3) is turned slowly in the direction of the arrow FWD (see FIG. 3), the variation amount per unit time of the opening degree of the lever 5*a* of the control lever portion 5, namely the accelerator opening degree differential, is small. As a result, the control section 52 can perform control based on a command from the user to accelerate the hull 2 by detecting the acceleration command from the user based on the accelerator opening degree differential. The control section 52 is an example of the "acceleration detection section" of a preferred embodiment of the present invention.

The control section 52 is preferably connected to both the common LAN cable 7 and the common LAN cable 8. Each of the common LAN cables 7 and 8 is connected to the ECU 34, and transmits a signal generated by the control section 52 to the ECU 34 and transmits a signal generated by the ECU 34 to the control section 52. That is, each of the common LAN cables 7 and 8 can communicate between the control section 52 and the ECU 34. The common LAN cable 8 is preferably electrically independent of the common LAN cable 7.

Specifically, the control section 52 transmits a shift position signal indicating the shift position of the lever 5*a* detected by the shift position sensor 53 to the display 6 and the ECU 34 via the common LAN cable 7. The control section 52 transmits the shift position signal only via the common LAN cable 7 and not via the common LAN cable 8. In addition, the control section 52 transmits an accelerator opening degree signal sensed by the accelerator position sensor 54 to the ECU 34 only via the common LAN cable 8 and not via the common LAN cable 7. Moreover, the control section 52 can receive an engine speed signal sent from the ECU 34 via the common LAN cable 8.

In this preferred embodiment, the control section 52 performs electric control so as to shift the speed reduction ratio of the gear shift mechanism 33 based on operation of the control lever portion 5 by the user. Specifically, the control section 52 generates a gear switching signal for shifting the gear shift mechanism 33 to the low speed reduction ratio based on the gear shift control map stored in the storage section 51 and prescribed by the accelerator opening degree and the engine speed. The gear shift control map will be described in detail below. Then, the control section 52 sends the generated gear switching signal to the ECU 34 via the common LAN cables 7 and 8.

In this preferred embodiment, the control section 52 is configured to set the rotational speed of the engine 31 at which the speed reduction ratio of the gear shift mechanism 33 is shifted based on the accelerator opening degree detected by the accelerator position sensor 54 and the accelerator opening degree differential calculated from the accelerator opening degree. That is, the control section 52 is configured to generate a gear switching signal for shifting the speed reduction ratio of the gear shift mechanism 33 based on the accelerator opening degree detected by the accelerator position sensor 54 and the acceleration command from the user. Specifically, the control section 52 is configured to select one of a high acceleration mode, a high fuel efficiency mode, and a normal travel mode to be discussed below based on the accelerator opening degree detected by the accelerator position sensor 54 and the accelerator opening degree differential calculated by the control section 52.

In the case where the lever 5*a* of the control lever portion 5 is turned forward (in the direction of the arrow FWD) (see FIG. 3), the gear shift mechanism 33 is controlled so as to move the hull 2 forward. In the case where the lever 5*a* of the control lever portion 5 is not turned in the fore-and-aft direction (as indicated by the solid line in FIG. 3), the gear shift mechanism 33 is in a neutral state, in which the hull 2 is propelled neither forward nor backward. In the case where the lever 5*a* of the control lever portion 5 is turned rearward (in the direction opposite to the direction of the arrow FWD) (see FIG. 3), the gear shift mechanism 33 is controlled so as to move the hull 2 backward.

Figure 3:
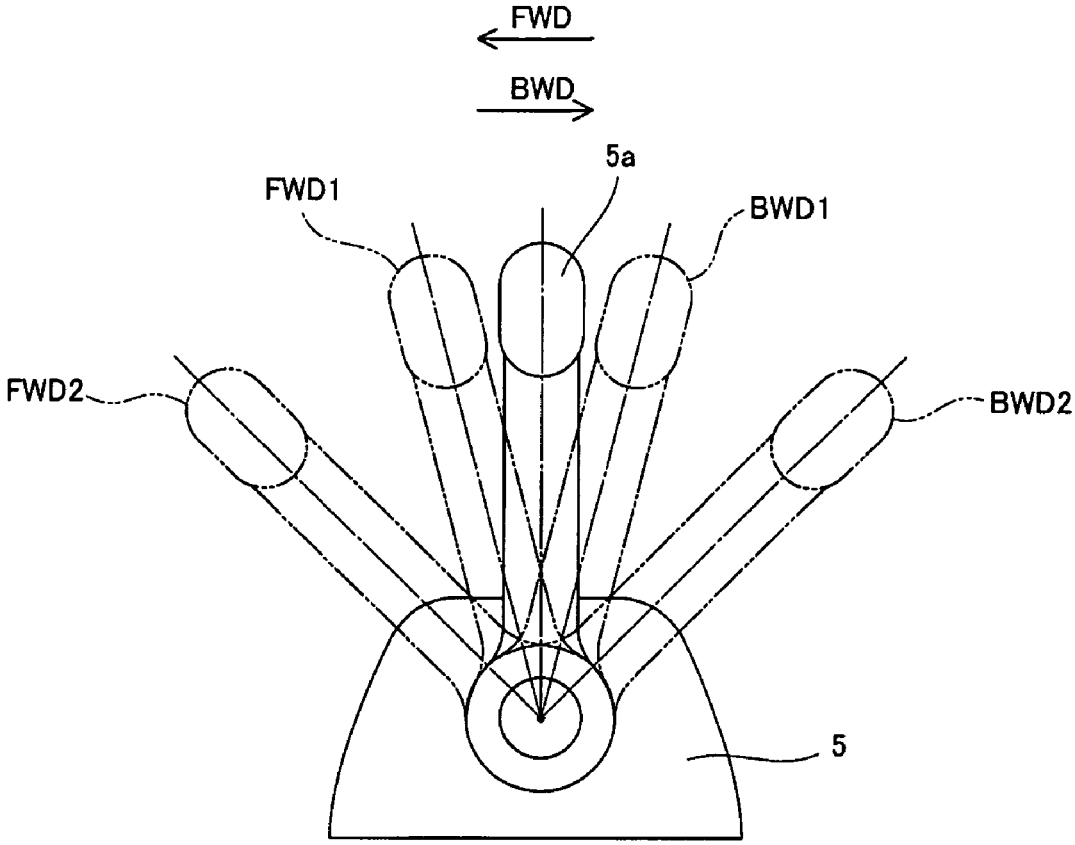
FIG. 3 is a side view illustrating the configuration of a control lever of the boat propulsion system in accordance with the preferred embodiment of the present invention shown in FIG. 1.

When the lever 5*a* of the control lever portion 5 is turned to FWD1 in FIG. 3, shift-in is performed (the neutral state is canceled) with the throttle (not shown) of the engine 31 fully closed (in the idling state). When the lever 5*a* of the control lever portion 5 is turned to FWD2 in FIG. 3, the throttle (not shown) of the engine 31 becomes fully open.

As in the case where the lever 5*a* of the control lever portion 5 is turned in the direction of the arrow FWD, shift-in is performed (the neutral state is canceled) with the throttle of the engine 31 fully closed (in the idling state) when the lever 5*a* is turned to BWD1 in FIG. 3 which is in the direction opposite to the direction of the arrow FWD. When the lever 5*a* of the control lever portion 5 is turned to BWD2 in FIG. 3, the throttle of the engine 31 becomes fully open. In the case where the lever 5*a* of the control lever portion 5 is positioned between FWD1 and BWD1 in FIG. 3, the control section 52 (see FIG. 2) determines that the lever opening degree (the accelerator opening degree) of the lever 5*a* of the control lever portion 5 is 0°. After shift-in (when the lever 5*a* of the control lever portion 5 is positioned between FWD1 and FWD2 or between BWD1 and BWD2 in FIG. 3), the control section 52 (see FIG. 2) calculates the accelerator opening degree differential, which is equivalent to the operation speed of the lever 5*a* of the control lever portion 5.

The display 6 includes a speed display section 61 for indicating the travel speed of the boat 1, a shift position display section 62 for indicating the shift position at which the lever 5*a* of the control lever portion 5 is currently positioned, and a gear display section 63 for indicating the gear with which the gear shift mechanism 33 is currently engaged, and a fuel efficiency display 64 for indicating the fuel efficiency. The travel speed of the boat 1 to be displayed on the speed display section 61 is calculated by the ECU 34 based on the engine speed sensor 35 and the air intake state of the engine 31. Data on the calculated travel speed of the boat 1 are transmitted to the display 6 via the common LAN cables 7 and 8. The shift position to be displayed on the shift position display section 62 is obtained based on the shift position signal sent from the control section 52 of the control lever portion 5. The gear with which the gear shift mechanism 33 is currently engaged and which is to be displayed on the gear display section 63 is obtained based on the gear switching signal sent from the control section 52 of the control lever portion 5. That is, the display 6 allows the user (boat operator) to understand the travel conditions of the boat 1.

Figure 4:
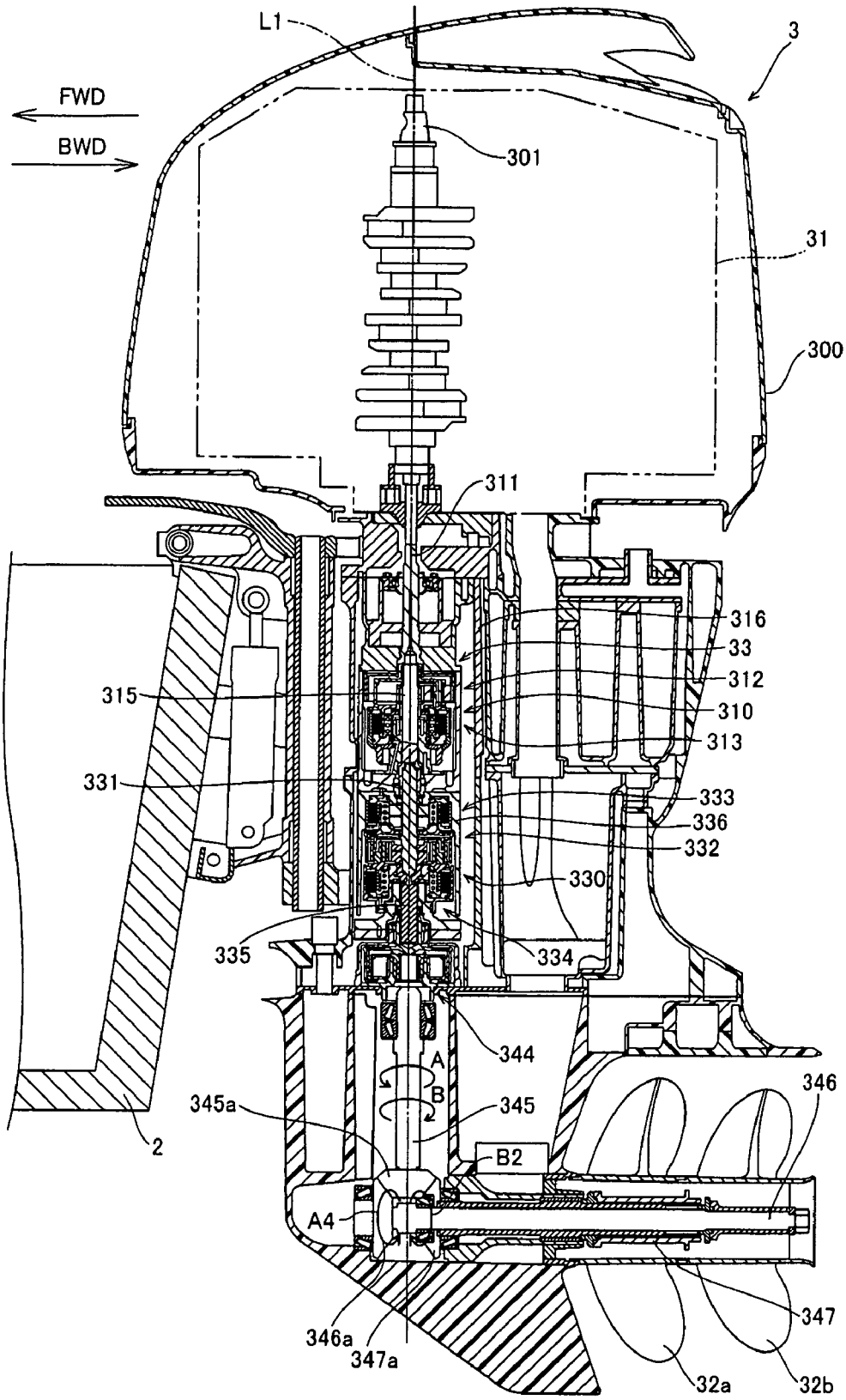
FIG. 4 is a cross-sectional view illustrating the configuration of a main unit of the boat propulsion system in accordance with the preferred embodiment of the present invention shown in FIG. 1.

Now, a description will be made of the configuration of the engine 31 and the gear shift mechanism 33. As shown in FIG. 4, the engine 31 is provided with a crankshaft 301 that is rotatable about an axis L1. The engine 31 generates a driving force by rotation of the crankshaft 301. The upper portion of an upper transmission shaft 311 of the gear shift mechanism 33 is connected to the crankshaft 301. The upper transmission shaft 311 is disposed on the axis L1 and rotates about the axis L1 as the crankshaft 301 rotates.

The gear shift mechanism 33 includes an upper gear shift portion 310 that includes the upper transmission shaft 311 to which the driving force of the engine 31 is input and that is arranged to shift so as to allow one of high-speed travel or low-speed travel of the boat 1, and a lower gear shift portion 330 arranged to shift so as to allow one of forward travel and backward travel of the boat 1. That is, the gear shift mechanism 33 can transmit the driving force generated by the engine 31 to the propellers 32*a* and 32*b* at the low speed reduction ratio (approximately 1.33:1) or the high speed reduction ratio (approximately 1:1) in forward travel, and to the propellers 32*a* and 32*b* at the low speed reduction ratio or the high speed reduction ratio in backward travel.

Figure 5:
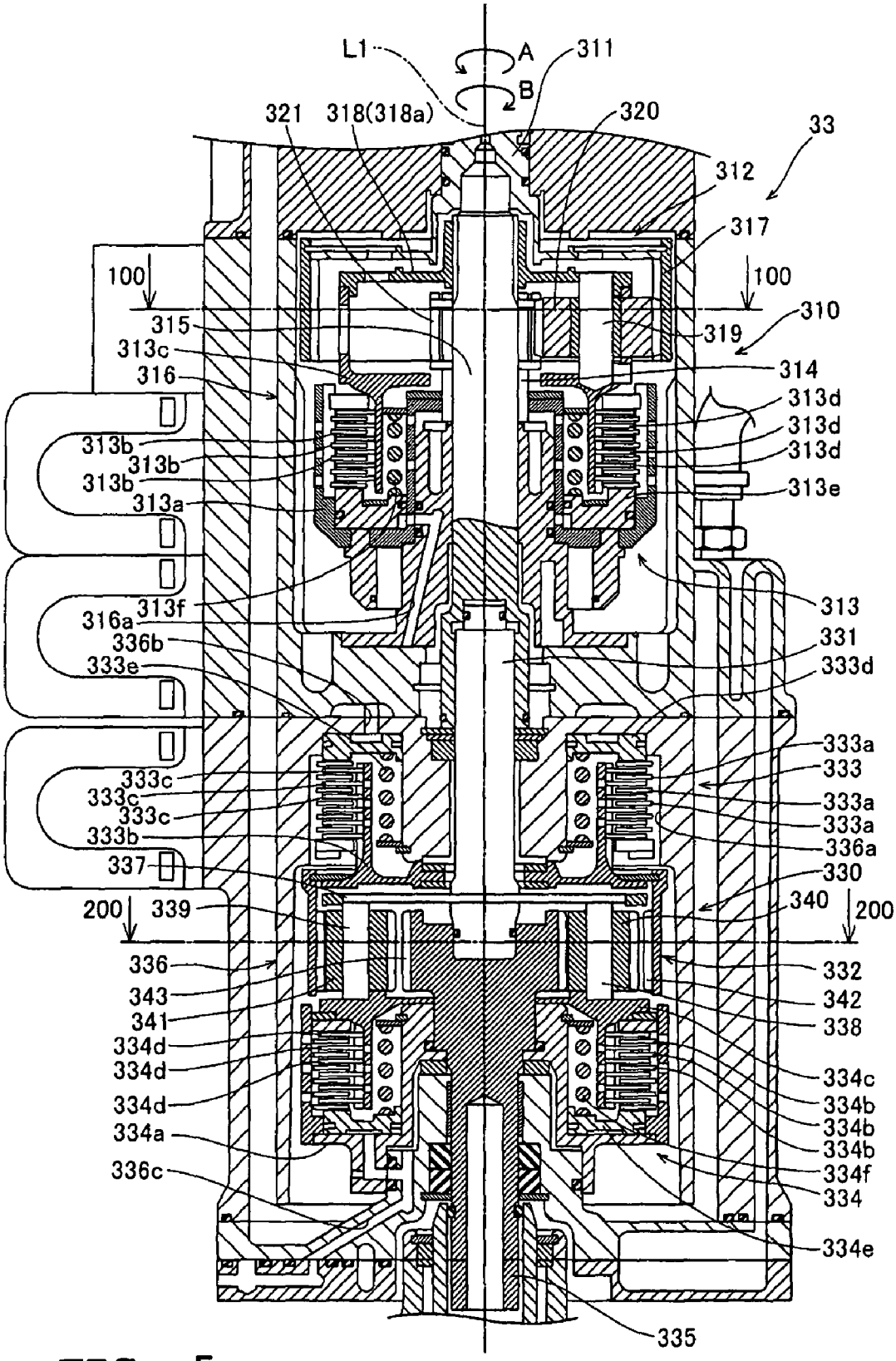
FIG. 5 is a cross-sectional view illustrating the configuration of a gear shift mechanism of the main unit of the boat propulsion system in accordance with the preferred embodiment of the present invention shown in FIG. 1.

As shown in FIG. 5, the upper gear shift portion 310 includes the upper transmission shaft 311, a planetary gear portion 312 arranged to reduce the speed of the driving force of the upper transmission shaft 311, a clutch portion 313 and a one-way clutch 314 arranged to control rotation of the planetary gear portion 312, an intermediate shaft 315 to which the driving force of the upper transmission shaft 311 is transmitted via the planetary gear portion 312, and an upper case portion 316 including a plurality of members to define the outer portion of the upper gear shift portion 310. In the case where the clutch portion 313 is engaged, the intermediate shaft 315 rotates at substantially the same speed as the rotational speed of the upper transmission shaft 311. On the other hand, in the case where the clutch portion 313 is disengaged, the planetary gear portion 312 rotates, and thus the intermediate shaft 315 rotates at a rotational speed that is reduced from the rotational speed of the upper transmission shaft 311.

Figure 6:
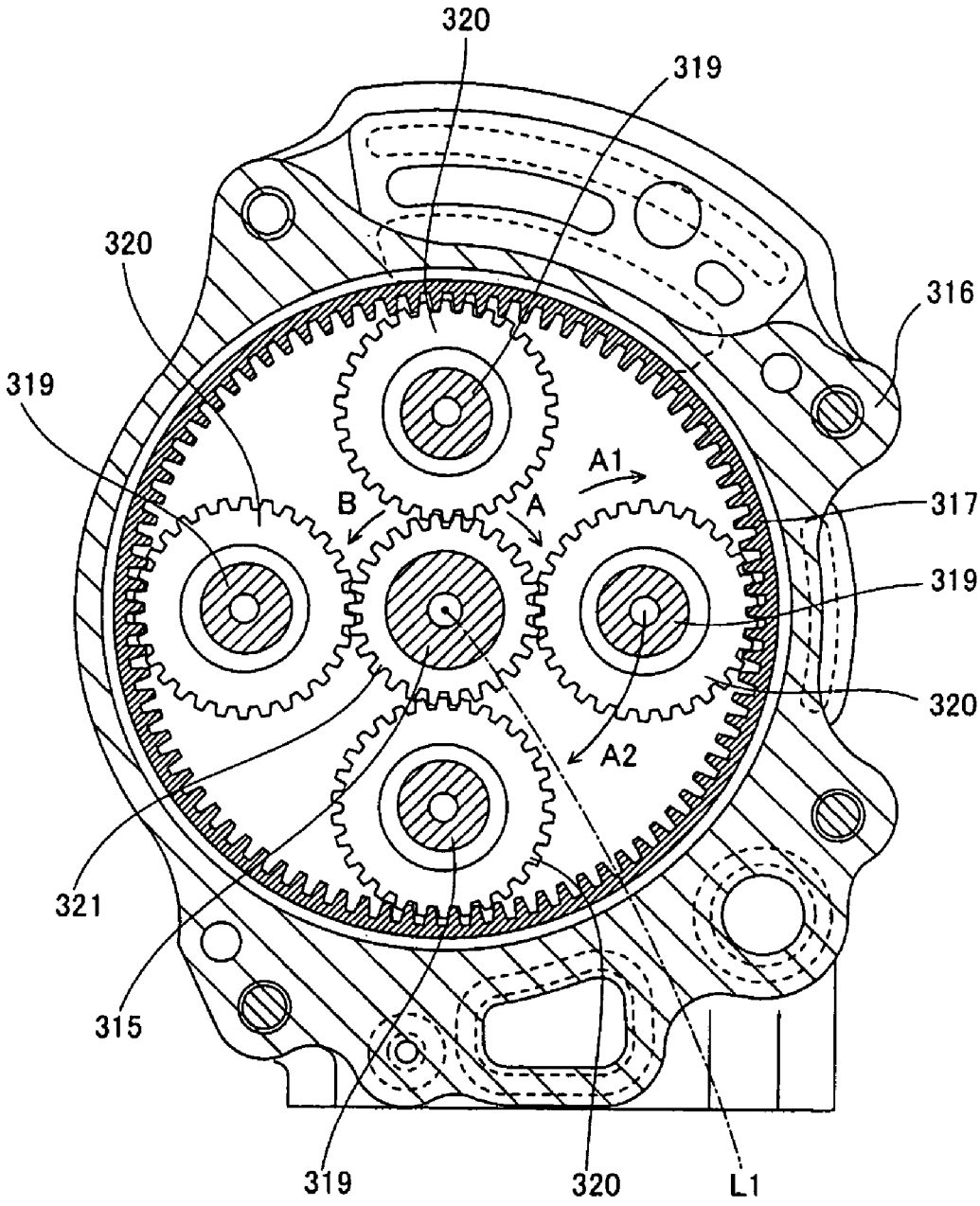
FIG. 6 is a cross-sectional view taken along the line of FIG. 5.

Specifically, a ring gear 317 is provided at the lower portion of the upper transmission shaft 311. A flange member 318 is preferably spline-fitted to the upper portion of the intermediate shaft 315. The flange member 318 is disposed inside the ring gear 317 (on the side of the axis L1). As shown in FIGS. 5 and 6, four shaft members 319 are fixed to a flange portion 318*a* of the flange member 318. Four planetary gears 320 are rotatably attached to the four shaft members 319, respectively. The four planetary gears 320 are each meshed with the ring gear 317. The four planetary gears 320 are also each meshed with a sun gear 321 that is rotatable about the axis L1. As shown in FIG. 5, the sun gear 321 is supported by the one-way clutch 314. The one-way clutch 314 is attached to the upper case portion 316 and rotatable only in the A direction. This allows the sun gear 321 to rotate only in one direction (the A direction).

The clutch portion 313 is preferably a wet-type multi-plate clutch. The clutch portion 313 preferably includes an outer case portion 313*a* supported by the one-way clutch 314 so as to be rotatable only in the A direction, a plurality of clutch plates 313*b* disposed in the inner peripheral portion of the outer case portion 313*a* with a certain gap between each other, an inner case portion 313*c* at least partially disposed inside the outer case portion 313*a*, and a plurality of clutch plates 313*d* attached to the inner case portion 313*c* and respectively disposed between the plurality of clutch plates 313*b*. In the case where the clutch plates 313*b* of the outer case portion 313*a* and the clutch plates 313*d* of the inner case portion 313*c* are contacted with each other, the clutch portion 313 is in the engaged state, in which the outer case portion 313*a* and the inner case portion 313*c* rotate integrally. On the other hand, in the case where the clutch plates 313*b* of the outer case portion 313*a* and the clutch plates 313*d* of the inner case portion 313*c* are separated from each other, the clutch portion 313 is in the disengaged state, in which the outer case portion 313*a* and the inner case portion 313*c* do not rotate integrally.

Specifically, a piston 313*e* that is slidable relative to the inner peripheral surface of the outer case portion 313*a* is disposed in the outer case portion 313*a*. When the piston 313*e* slides relative to the inner peripheral surface of the outer case portion 313*a*, the piston 313*e* moves each of the plurality of clutch plates 313*b* of the outer case portion 313*a* in the sliding direction of the piston 313*e*. A compression coil spring 313*f* is also disposed in the outer case portion 313*a*. The compression coil spring 313*f* is disposed to urge the piston 313*e* in the direction to separate the clutch plates 313*b* of the outer case portion 313*a* and the clutch plates 313*d* of the inner case portion 313*c* from each other. When the electromagnetic hydraulic control valve 37 increases the pressure of oil flowing through an oil passage 316*a* in the upper case portion 316, the piston 313*e* slides relative to the inner peripheral surface of the outer case portion 313*a* against the reaction force of the compression coil spring 313*f*. Increasing and decreasing the pressure of oil flowing through the oil passage 316*a* in the upper case portion 316 in this way can cause the clutch plates 313*b* of the outer case portion 313*a* and the clutch plates 313*d* of the inner case portion 313*c* to contact with and separate from each other, which enables the clutch portion 313 to be engaged and disengaged.

The lower ends of the four shaft members 319 are attached to the upper portion of the inner case portion 313*c*. That is, the inner case portion 313*c* is connected via the four shaft members 319 to the flange member 318, to which the upper portions of the four shaft members 319 are attached. This enables the inner case portion 313*c* and the flange portion 318 and the shaft members 319 to rotate about the axis L1 at the same time.

With the planetary gear portion 312 and the clutch portion 313 configured as described above, the ring gear 317 rotates in the A direction as the upper transmission shaft 311 rotates in the A direction in the case where the clutch portion 313 is disengaged. At this time, since the sun gear 321 does not rotate in the B direction opposite to the A direction, the planetary gears 320 move in the A2 direction about the axis L1 together with the shaft members 319 while rotating in the A1 direction about the shaft members 319, as shown in FIG. 6. This allows the flange member 318 (see FIG. 5) to rotate in the A direction about the axis L1 as the shaft members 319 move in the A2 direction. As a result, the intermediate shaft 315 preferably spline-fitted to the flange member 318 is enabled to rotate in the A direction about the axis L1 at a rotational speed that is reduced from the rotational speed of the upper transmission shaft 311.

With the planetary gear portion 312 and the clutch portion 313 configured as described above, the ring gear 317 rotates in the A direction as the upper transmission shaft 311 rotates in the A direction in the case where the clutch portion 313 is engaged. At this time, since the sun gear 321 does not rotate in the B direction opposite to the A direction, the planetary gears 320 move in the A2 direction about the axis L1 together with the shaft members 319 while rotating in the A1 direction about the shaft members 319. At this time, since the clutch portion 313 is engaged, the outer case portion 313*a* (see FIG. 5) of the clutch portion 313 rotates in the A direction together with the one-way clutch 314 (see FIG. 5). Consequently, the sun gear 321 is rotated in the A direction about the axis L1, and thus the shaft members 319 move in the A direction about the axis L1 without the planetary gears 320 substantially rotating about the shaft members 319. This allows the flange member 318 to rotate at a rotational speed that is not substantially reduced by the planetary gears 320, but at generally the same rotational speed as the rotational speed of the upper transmission shaft 311. As a result, the intermediate shaft 311 can be caused to rotate in the A direction about the axis L1 at generally the same rotational speed as the rotational speed of the upper transmission shaft 311.

As shown in FIG. 5, the lower gear shift portion 330 is provided below the upper gear shift portion 310. The lower gear shift portion 330 includes an intermediate transmission shaft 331 connected to the intermediate shaft 315, a planetary gear portion 332 arranged to reduce the speed of the driving force of the intermediate transmission shaft 331, a forward/reverse switching clutch portion 333 and a forward/reverse switching clutch portion 334 for controlling rotation of the planetary gear portion 332, a lower transmission shaft 335 to which the driving force of the intermediate transmission shaft 331 is transmitted via the planetary gear portion 332, and a lower case portion 336 defining the outer portion of the lower gear shift portion 330. The lower gear shift portion 330 is configured such that the lower transmission shaft 335 rotates in the opposite direction (B direction) to the rotational direction (A direction) of the intermediate shaft 315 (the upper transmission shaft 311) in the case where the forward/reverse switching clutch portion 333 is engaged and the forward/reverse switching clutch portion 334 is disengaged. In this case, the lower gear shift portion 330 rotates only the propeller 32*a* and not the propeller 32*b* so that the boat 1 can travel backward. On the other hand, the lower gear shift portion 330 is configured such that the lower transmission shaft 335 rotates in the same direction as the rotational direction (A direction) of the intermediate shaft 315 (the upper transmission shaft 311) in the case where the forward/reverse switching clutch portion 333 is disengaged and the forward/reverse switching clutch portion 334 is engaged. In this case, the lower gear shift portion 330 rotates the propeller 32*a* in the direction opposite to the rotational direction of the propeller 32*a* in the case where the boat 1 is to travel rearward, and also rotates the propeller 32*b* in the direction opposite to the rotational direction of the propeller 32*a*, so that the boat 1 can travel forward. The lower gear shift portion 330 is configured such that both the forward/reverse switching clutch portions 333 and 334 will not be engaged at the same time. The lower gear shift portion 330 is also configured such that rotation of the intermediate shaft 315 (the upper transmission shaft 311) is not transmitted to the lower transmission shaft 335 (in the neutral state) in the case where both the forward/reverse switching clutch portions 333 and 334 are disengaged.

Figure 7:
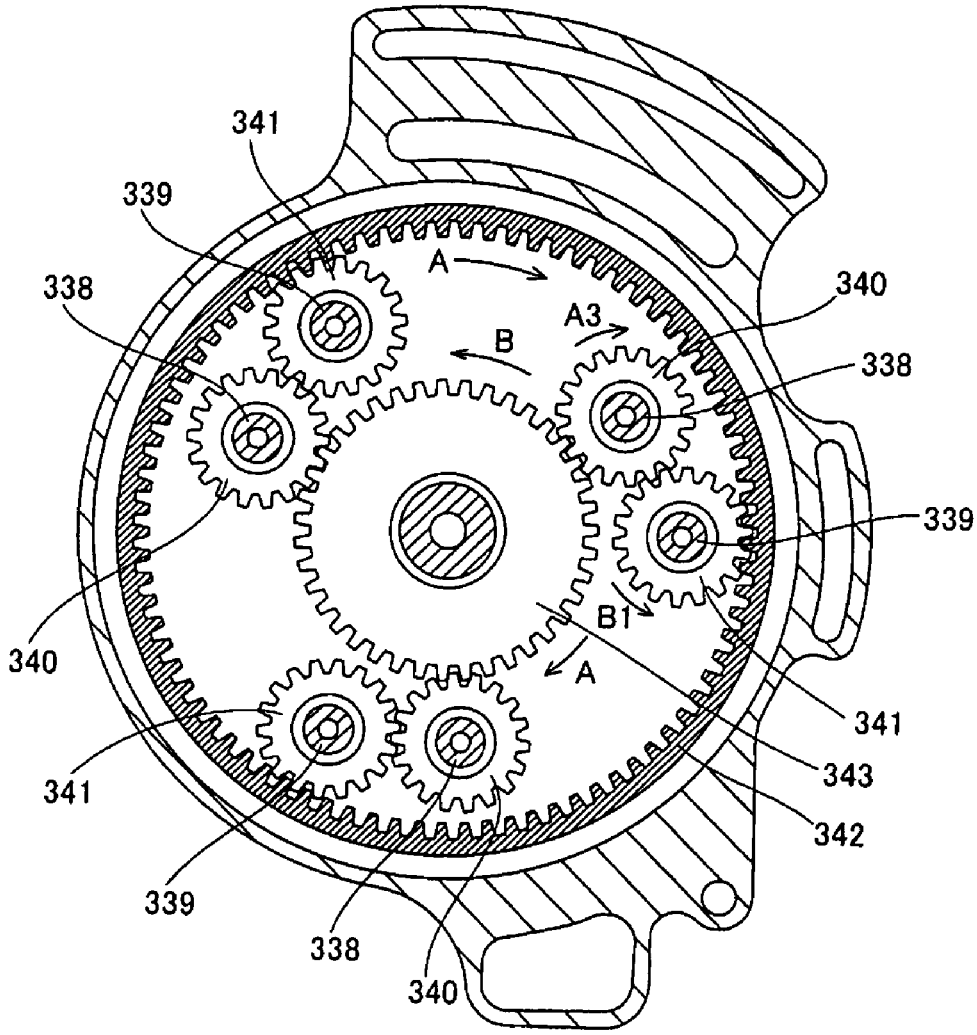
FIG. 7 is a cross-sectional view taken along the line 200-200 of FIG. 5.

Specifically, the intermediate transmission shaft 331 rotates together with the intermediate shaft 315. A flange member 337 is provided at the lower portion of the intermediate transmission shaft 331. As shown in FIGS. 5 and 7, three inner shaft members 338 and three outer shaft members 339 are fixed to the flange portion 337. Three inner planetary gears 340 are respectively rotatably attached to the three inner shaft members 338. The three inner planetary gears 340 are each meshed with a sun gear 343 to be discussed below. Three outer planetary gears 341 are respectively rotatably attached to the three outer shaft members 339. The three outer planetary gears 341 are respectively meshed with the inner planetary gears 340 and are each meshed with a ring gear 342 to be discussed below.

The forward/reverse switching clutch portion 333 is provided in the upper portion inside the lower case portion 336. The forward/reverse switching clutch portion 333 is preferably a wet-type multi-plate clutch, and includes a recessed portion 336*a* of the lower case portion 336. The forward/reverse switching clutch portion 333 includes a plurality of clutch plates 333*a* disposed in the inner peripheral portion of the recessed portion 336*a* with a certain gap between each other, an inner case portion 333*b* at least partially disposed inside the recessed portion 336*a*, and a plurality of clutch plates 333*c* attached to the inner case portion 333*b* and respectively disposed between the plurality of clutch plates 333*a*. The forward/reverse switching clutch portion 333 is configured such that rotation of the inner case portion 333*b* is restricted by the lower case portion 336 in the case where the clutch plates 333*a* of the recessed portion 336*a* and the clutch plates 333*c* of the inner case portion 333*b* are contacted with each other. On the other hand, the forward/reverse switching clutch portion 333 is configured such that the inner case portion 333*b* can freely rotate relative to the lower case portion 336 in the case where the clutch plates 333*a* of the recessed portion 336*a* and the clutch plates 333*c* of the inner case portion 333*b* are separated from each other.

Specifically, a piston 333*d* that is slidable relative to the inner peripheral surface of the recessed portion 336*a* is disposed in the recessed portion 336*a* of the lower case portion 336. When the piston 333*d* slides relative to the inner peripheral surface of the recessed portion 336*a*, the piston 333*d* moves the clutch plates 333*a* of the recessed portion 336*a* in the sliding direction of the piston 333*d*. A compression coil spring 333*e* is also disposed in the recessed portion 336*a* of the lower case portion 336. The compression coil spring 333*e* is disposed to urge the piston 333*d* in the direction to separate the clutch plates 333*a* of the recessed portion 336*a* and the clutch plates 333*c* of the inner case portion 333*b* from each other. When the electromagnetic hydraulic control valve 37 increases the pressure of oil flowing through an oil passage 336*b* in the lower case portion 336, the piston 333*d* slides relative to the inner peripheral surface of the recessed portion 336*a* against the reaction force of the compression coil spring 333*e*. Increasing and decreasing the pressure of oil flowing through the oil passage 336*b* in the lower case portion 336 in this way enables the forward/reverse switching clutch portion 333 to be engaged and disengaged.

An annular ring gear 342 is attached to the inner case portion 333*b* of the forward/reverse switching clutch portion 333. As shown in FIGS. 5 and 7, the ring gear 342 is meshed with the three outer planetary gears 341.

As shown in FIG. 5, the forward/reverse switching clutch portion 334 is provided in the lower portion inside the lower case portion 336, and preferably includes a wet-type multi-plate clutch. The forward/reverse switching clutch portion 334 includes an outer case portion 334*a*, a plurality of clutch plates 334*b* disposed in the inner peripheral portion of the outer case portion 334*a* with a certain gap between each other, an inner case portion 334*c* at least partially disposed inside the outer case portion 334*a*, and a plurality of clutch plates 334*d* attached to the inner case portion 334*c* and respectively disposed between the plurality of clutch plates 334*b*. The forward/reverse switching clutch portion 334 is configured such that the inner case portion 334*c* and the outer case portion 334*a* rotate integrally about the axis L1 in the case where the clutch plates 334*b* of the outer case portion 334*a* and the clutch plates 334*d* of the inner case portion 334*c* are contacted with each other. On the other hand, the forward/reverse switching clutch portion 334 is configured such that the inner case portion 334*c* can freely rotate relative to the outer case portion 334*a* in the case where the clutch plates 334*b* of the outer case portion 334*a* and the clutch plates 334*d* of the inner case portion 334*c* are separated from each other.

Specifically, a piston 334*e* that is slidable relative to the inner peripheral surface of the outer case portion 334*a* is disposed in the outer case portion 334*a*. When the piston 334*e* slides relative to the inner peripheral surface of the outer case portion 334*a*, the piston 334*e* moves the plurality of clutch plates 334*b* of the outer case portion 334*a* in the sliding direction of the piston 334*e*. A compression coil spring 334*f* is also disposed inside the outer case portion 334*a*. The compression coil spring 334*f* is disposed to urge the piston 334*e* in the direction to separate the clutch plates 334*b* of the outer case portion 334*a* and the clutch plates 334*d* of the inner case portion 334*c* from each other. When the electromagnetic hydraulic control valve 37 increases the pressure of oil flowing through an oil passage 336*c* in the lower case portion 336, the piston 334*e* slides relative to the inner peripheral surface of the outer case portion 334*a* against the reaction force of the compression coil spring 334*f*. Increasing and decreasing the pressure of oil flowing through the oil passage 336*c* in the lower case portion 336 enables the forward/reverse switching clutch portion 334 to be engaged and disengaged.

The three inner shaft members 338 and the three outer shaft members 339 are fixed to the inner case portion 334*c* of the forward/reverse switching clutch portion 334. That is, the inner case portion 334*c* is connected through the three inner shaft members 338 and the three outer shaft members 339 to the flange portion 337 so as to rotate about the axis L1 together with the flange portion 337. The outer case portion 334*a* of the forward/reverse switching clutch portion 334 is attached to the lower transmission shaft 335 so as to rotate about the axis L1 together with the lower transmission shaft 335.

A sun gear 343 is preferably integral with the upper portion of the lower transmission shaft 335. As shown in FIG. 7, the sun gear 343 is meshed with the inner planetary gears 340, which are meshed with the outer planetary gears 341, which are meshed with the ring gear 342. In the case where the forward/reverse switching clutch portion 333 is engaged and thus the ring gear 342 does not rotate, the sun gear 343 rotates in the B direction about the axis L1 via the inner planetary gears 340 and the outer planetary gears 341 when the intermediate transmission shaft 331 rotates in the A direction about the axis L1 to accordingly rotate the flange portion 337 in the A direction.

With the planetary gear portion 332 and the forward/reverse switching clutch portions 333 and 334 configured as described above, the ring gear 342 attached to the inner case portion 333*b* is fixed relative to the lower case portion 336 in the case where the forward/reverse switching clutch portion 333 is engaged. At this time, since the forward/reverse switching clutch portion 334 is disengaged as described above, the outer case portion 334*a* and the inner case portion 334*c* of the forward/reverse switching clutch portion 334 are rotatable separately from each other. In this case, when the intermediate transmission shaft 331 rotates in the A direction about the axis L1 to accordingly rotate the flange portion 337 in the A direction about the axis L1, each of the three inner shaft members 338 and the three outer shaft members 339 moves in the A direction about the axis L1. At this time, the outer planetary gears 341 attached to the outer shaft members 339 rotate in the B1 direction about the outer shaft members 339. As the outer planetary gears 341 rotate, the inner planetary gears 340 rotate in the A3 direction about the inner shaft members 338. This causes the sun gear 343 to rotate in the B direction about the axis L1. As a result, the lower transmission shaft 335 rotates in the B direction about the axis L1 together with the outer case portion 334*a* although the inner case portion 334*c* rotates in the A direction about the axis L1, as shown in FIG. 5. This allows the lower transmission shaft 335 to rotate in the opposite direction (B direction) to the rotational direction (A direction) of the intermediate shaft 315 (the upper transmission shaft 311) in the case where the forward/reverse switching clutch portion 333 is engaged and the forward/reverse switching clutch portion 334 is disengaged.

With the planetary gear portion 332 and the forward/reverse switching clutch portions 333 and 334 configured as described above, the ring gear 342 attached to the inner case portion 333*b* can freely rotate relative to the lower case portion 336 in the case where the forward/reverse switching clutch portion 333 is disengaged. At this time, the forward/reverse switching clutch portion 334 may be either engaged or disengaged as described above.

Now, a description will be made of the case where the forward/reverse switching clutch portion 334 is engaged. In the case where the intermediate transmission shaft 331 rotates in the A direction about the axis L1 to accordingly rotate the flange portion 337 in the A direction, each of the three inner shaft members 338 and the three outer shaft members 339 rotates in the A direction about the axis L1, as shown in FIG. 7. At this time, since the ring gear 342 meshed with the outer planetary gears 341 can freely rotate, the inner planetary gears 340 and the outer planetary gears 341 idle. That is, the driving force of the intermediate transmission shaft 331 is not transmitted to the sun gear 343. Meanwhile, since the forward/reverse switching clutch portion 334 is engaged, the outer case portion 334*a* rotates in the A direction about the axis L1 as the inner case portion 334*c*, which can rotate in the A direction about the axis L1 together with the three inner shaft members 338 and the three outer shaft members 339, rotates in the A direction about the axis L1, as shown in FIG. 5. This causes the lower transmission shaft 335 to rotate in the A direction about the axis L1 together with the outer case portion 334*a*. As a result, the lower transmission shaft 335 can be caused to rotate in the same direction as the rotational direction (A direction) of the intermediate shaft 315 (the upper transmission shaft 311) in the case where the forward/reverse switching clutch portion 333 is disengaged and the forward/reverse switching clutch portion 334 is engaged.

As shown in FIG. 4, a speed reduction device 344 is provided below the gear shift mechanism 33. The speed reduction device 344 receives the lower transmission shaft 335 of the gear shift mechanism 33. The speed reduction device 344 reduces the speed of the driving force input through the lower transmission shaft 335. A drive shaft 345 is provided below the speed reduction device 344. The drive shaft 345 is configured to rotate in the same direction as the rotational direction of the lower transmission shaft 335. A bevel gear 345*a* is provided at the lower portion of the drive shaft 345.

The bevel gear 345*a* of the drive shaft 345 is meshed with a bevel gear 346*a* of an inner output shaft 346 and a bevel gear 347*a* of an outer output shaft 347. The inner output shaft 346 is disposed to extend rearward (in the direction of the arrow BWD), and the propeller 32*b* is attached to the inner output shaft 346 on the side in the direction of the arrow BWD. As with the inner output shaft 346, the outer output shaft 347 is also disposed to extend in the direction of the arrow BWD, and the propeller 32*a* is attached to the outer output shaft 347 on the side in the direction of the arrow BWD. The outer output shaft 347 is hollow, and the inner output shaft 346 is inserted into the hollow portion of the outer output shaft 347. The inner output shaft 346 and the outer output shaft 347 are rotatable independently of each other.

The bevel gear 346*a* is meshed with the bevel gear 345*a* on the side in the direction of the arrow FWD, while the bevel gear 347*a* is meshed with the bevel gear 345*a* on the side in the direction of the arrow BWD. This allows the inner output shaft 346 and the outer output shaft 347 to rotate in different directions from each other when the bevel gear 345*a* rotates.

Specifically, in the case where the drive shaft 345 rotates in the A direction, the bevel gear 346*a* rotates in the A4 direction. As the bevel gear 346*a* rotates in the A4 direction, the propeller 32*b* rotates in the A4 direction via the inner output shaft 346. Meanwhile, in the case where the drive shaft 345 rotates in the A direction, the bevel gear 347*a* rotates in the B2 direction. As the bevel gear 347*a* rotates in the B2 direction, the propeller 32*a* rotates in the B2 direction via the outer output shaft 347. Then, the boat 1 navigates in the direction of the arrow FWD (the forward direction) with the propeller 32*a* rotating in the B2 direction and the propeller 32*b* rotating in the A4 direction (opposite to the B2 direction).

On the other hand, in the case where the drive shaft 345 rotates in the B direction, the bevel gear 346*a* rotates in the B2 direction. As the bevel gear 346*a* rotates in the B2 direction, the propeller 32*b* rotates in the B2 direction via the inner output shaft 346. Meanwhile, in the case where the drive shaft 345 rotates in the B direction, the bevel gear 347*a* rotates in the A4 direction. At this time, the outer output shaft 347 does not rotate in the A4 direction, and thus the propeller 32*a* rotates neither in the A4 direction nor in the B2 direction. That is, only the propeller 32*b* rotates in the A4 direction. Then, the boat 1 travels in the direction of the arrow BWD (the backward direction) with the propeller 32*b* rotating in the B2 direction.

Figure 8:
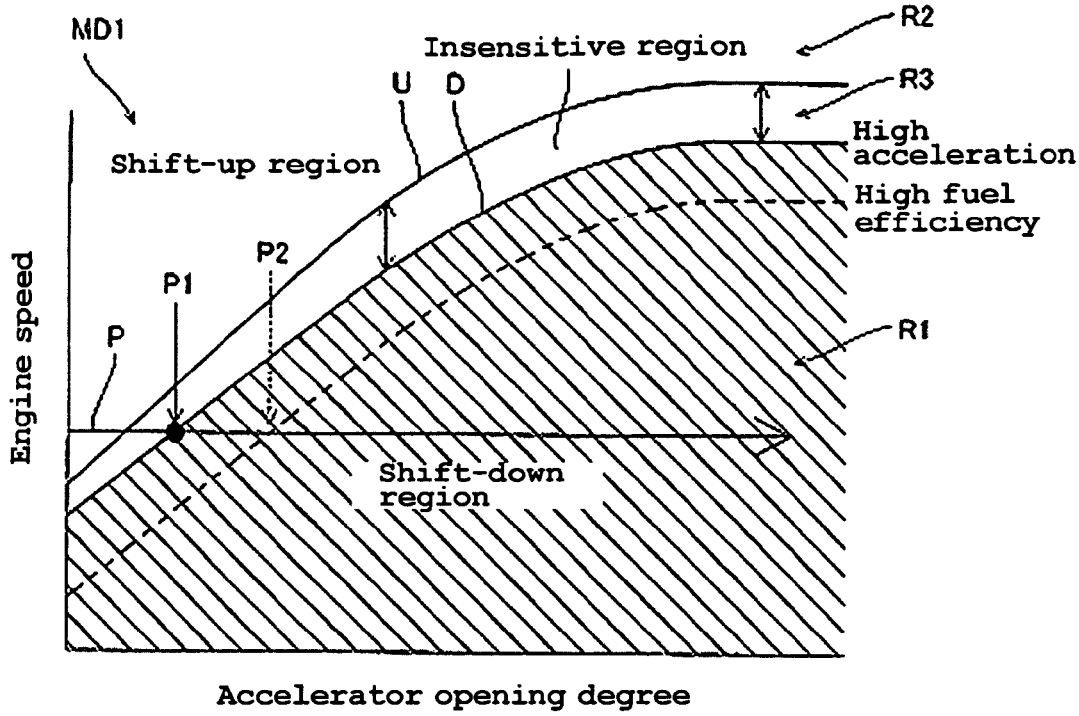
FIG. 8 illustrates a gear shift control map for shifting-down in a high acceleration mode of the boat propulsion system in accordance with a preferred embodiment of the present invention.
Figure 9:
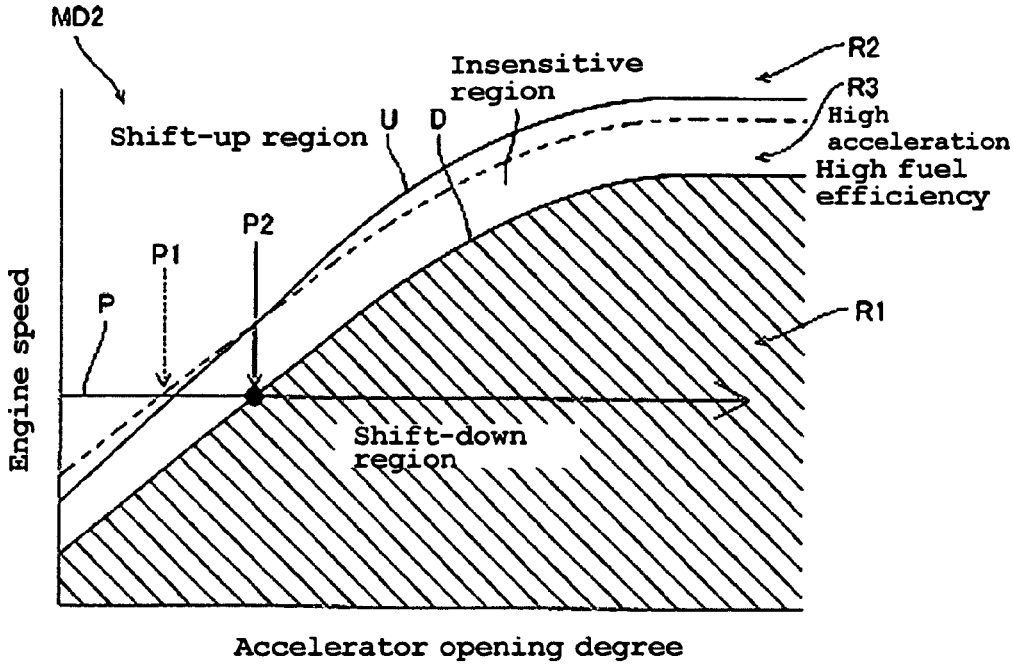
FIG. 9 illustrates a gear shift control map for shifting-down in a high fuel efficiency mode of the boat propulsion system in accordance with a preferred embodiment of the present invention.

FIGS. 8 and 9 illustrate the gear shift control map stored in the storage section of the boat propulsion system in accordance with a preferred embodiment of the present invention. FIGS. 10 to 13 illustrate the mode selection map in accordance with a preferred embodiment of the present invention. Now, a description will be made of the gear shift control map and the mode selection map of the boat propulsion system in accordance with a preferred embodiment of the present invention with reference to FIGS. 1 to 3, 5, and 8 to 13.

As shown in FIGS. 8 and 9, a gear shift control map MD1 shows a region to shift the speed reduction ratio of the gear shift mechanism 33 (see FIG. 4) to a different speed reduction ratio in the case where a high acceleration mode to be discussed below is selected, while a gear shift control map MD2 shows a region to shift the speed reduction ratio of the gear shift mechanism 33 to a different speed reduction ratio in the case where a high fuel efficiency mode to be discussed below is selected. The gear shift control maps MD1 (see FIG. 8) and MD2 (see FIG. 9) in accordance with this preferred embodiment use the rotational speed of the engine 31 (the engine speed) and the accelerator opening degree as parameters. In the gear shift control maps MD1 and MD2, the vertical axis represents the engine speed while the horizontal axis represents the accelerator opening degree. The gear shift control maps MD1 and MD2 each include a shift-down region R1 prescribing the low speed reduction ratio, a shift-up region R2 prescribing the high speed reduction ratio, and an insensitive region R3 provided between the shift-down region R1 and the shift-up region R2. The gear shift control map MD1 and the gear shift control map MD2 are respective examples of the "second gear shift control map" and the "first gear shift control map". The shift-down region R1 and the shift-up region R2 are respective examples of the "first region" and the "second region". The gear shift control maps MD1 and MD2 in accordance with this preferred embodiment are used for forward and backward operation of the boat 1.

In the case where a locus P defined by the engine speed of the boat 1 and the throttle opening degree enters from the shift-up region R2 into the shift-down region R1 via the insensitive region R3 on the gear shift control maps of FIGS. 8 and 9, the control section 52 and the ECU 34 control the gear shift mechanism 33 so as to shift down (shift from the high speed reduction ratio to the low speed reduction ratio). The insensitive region R3 is provided to prevent frequent gear shifts. A gear shift is not performed when the locus P only enters from the shift-up region R2 into the insensitive region R3. The insensitive region R3 is in the shape of a belt provided between a shift-down reference line D provided on the side of the shift-down region R1 prescribing the low speed reduction ratio and a shift-up reference line U provided on the side of the shift-up region R2 prescribing the high speed reduction ratio.

In this preferred embodiment, the control section 52 shifts the speed reduction ratio of the gear shift mechanism 33 based on the gear shift control maps MD1 and MD2 in the case where an acceleration command from the user is detected from the accelerator opening degree differential calculated from the accelerator opening degree of the lever 5*a* of the control lever portion 5. Specifically, in the case where the high acceleration mode to be discussed below is selected, and at the same accelerator opening degree of the lever 5*a* of the control lever portion 5, the control section 52 sets the rotational speed of the engine 31 at which the speed reduction ratio of the gear shift mechanism 33 is shifted to the high speed reduction ratio to a rotational speed that is higher than in the case where the high fuel efficiency mode different from the high acceleration mode is selected. In the case where the high fuel efficiency mode to be discussed below is selected, and at the same accelerator opening degree of the lever 5*a* of the control lever portion 5, the control section 52 sets the rotational speed of the engine 31 at which the speed reduction ratio of the gear shift mechanism 33 is shifted to the high speed reduction ratio to a rotational speed that is lower than in the case where the high acceleration mode different from the high fuel efficiency mode is selected.

Specifically, the storage section 51 (see FIG. 2) stores the gear shift control map MD1 shown in FIG. 8 and corresponding to the high acceleration mode to be discussed below, and the gear shift control map MD2 shown in FIG. 9 and corresponding to the high fuel efficiency mode to be discussed below. As shown in FIGS. 8 and 9, the engine speed at which shift-down is performed is higher in the shift-down region R1 in the gear shift control map MD1 for the high acceleration mode than in the shift-down region R1 in the gear shift control map MD2 for the high fuel efficiency mode at the same accelerator opening degree. Consequently, the low speed reduction ratio which produces higher torque is used for a longer period in the high acceleration mode than in the high fuel efficiency mode. For example, in the case where the engine speed and the throttle opening degree vary according to the locus P, shift-down is performed at timing P1 in the high acceleration mode, as shown in FIG. 8. On the other hand, in the high fuel efficiency mode, shift-down is performed at timing P2 later than timing P1, as shown in FIG. 9.

Figure 10:
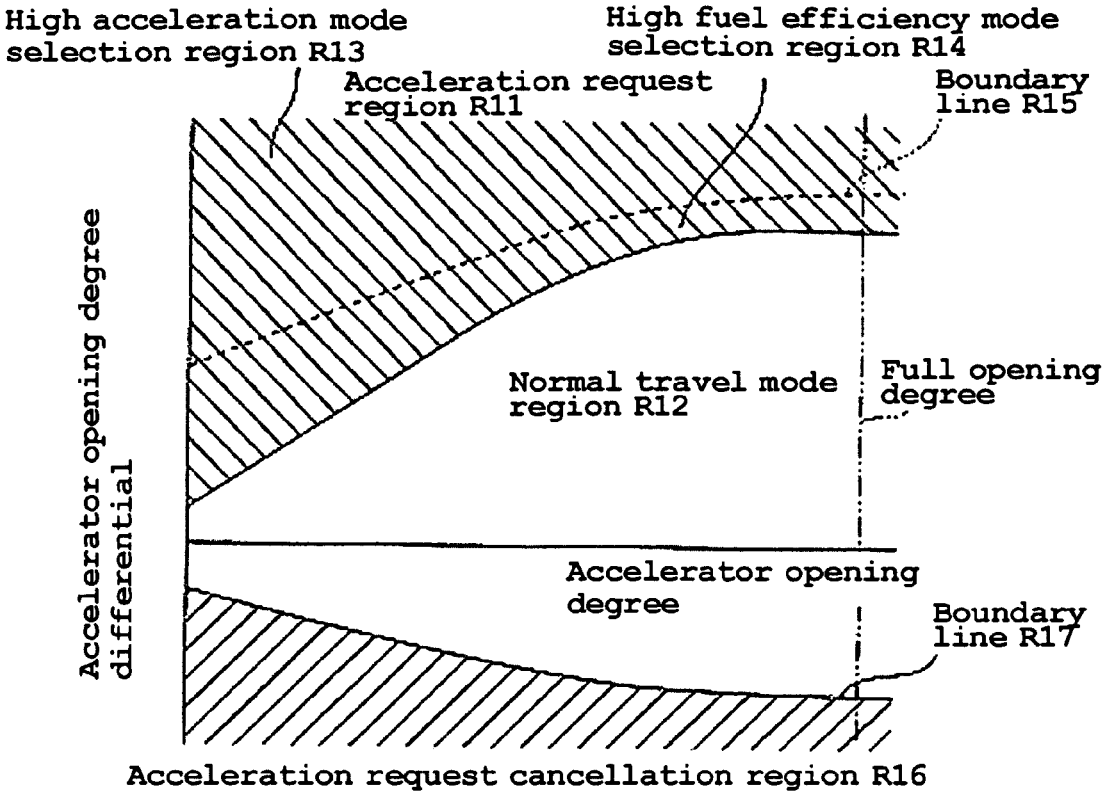
FIG. 10 illustrates a mode selection map of the boat propulsion system in accordance with a preferred embodiment of the present invention.

As shown in FIG. 10, the mode selection map in accordance with this preferred embodiment is represented by the accelerator opening degree and the accelerator opening degree differential calculated from the accelerator opening degree. In the mode selection map, the vertical axis represents the accelerator opening degree differential while the horizontal axis represents the accelerator opening degree (the lever opening degree). The accelerator opening degree differential is used as an index representing the acceleration command from the user. The mode selection map includes an acceleration request region R11 prescribing the detection state of the acceleration command from the user, a normal travel mode region R12 positioned below the acceleration request region R11, and an acceleration request cancellation region R16 positioned below the normal travel mode region R12. That is, the acceleration request region R11 corresponds to an acceleration command from the user. In the normal travel mode, the control section 52 performs control so as to keep the speed reduction ratio of the gear shift mechanism 33 at the high speed reduction ratio. As shown in FIG. 10, the acceleration request region R11 includes a high acceleration mode selection region R13, a high fuel efficiency mode selection region R14 provided below (where the accelerator opening degree differential is smaller) the high acceleration mode selection region R13, and a boundary line R15 positioned between the high acceleration mode selection region R13 and the high fuel efficiency mode selection region R14. The high acceleration mode selection region R13 prescribes the high acceleration mode for rapidly accelerating the hull 2 (see FIG. 1) in the case where it is determined that there is a strong acceleration command from the user (in the case where the variation amount per unit time of the operation speed of the lever 5*a* of the control lever portion 5, that is, the opening degree of the lever 5*a*, is determined to be larger than a certain value). In the high acceleration mode, the region of the engine speed and the throttle opening at which shift-down is performed is set according to the gear shift control map MD1 (see FIG. 9). In the normal travel mode region R12, also, the speed reduction ratio is not limited to the high speed reduction ratio and may be shifted to the low speed reduction ratio depending on the load conditions of the engine 31. For example, in the case where the rotational speed of the engine 31 is lowered more than expected or in the case where the forward/reverse switching clutch portion 333 is to be engaged, the speed reduction ratio may be temporarily shifted to the low speed reduction ratio for the purpose of anti-vibration measures also in the normal travel mode region R12.

The high fuel efficiency mode is selected in the case where there is an acceleration command from the user, which is slightly weaker than in the high acceleration mode, that is, in the case where the variation amount per unit time of the opening degree of the lever 5*a* is determined to be slightly smaller than in the high acceleration mode, such as in the case where the operation speed of the lever 5*a* of the control lever portion 5 is lower than when the high acceleration mode is to be selected but higher than when the normal travel mode is to be selected. In the high fuel efficiency mode, the region of the engine speed and the throttle opening degree in which shift-down is performed is set according to the gear shift control map MD2 (see FIG. 9). The high fuel efficiency mode is used to accelerate the hull 2 (see FIG. 1) more slowly (slow acceleration) than in the case where the high acceleration mode is selected. In the acceleration request cancellation region R16 of the mode selection map, the accelerator opening degree differential is smaller than in the normal travel mode region R12, and the high acceleration mode or the high fuel efficiency mode is canceled to select the normal travel mode. The mode selection map includes a boundary line R17 between the normal travel mode region R12 and the acceleration request cancellation region R16.

The control section 52 performs a mode determination when the locus represented by the accelerator opening degree and the accelerator opening degree differential moves out of a certain region into another on the mode selection map, and determines whether or not the mode determination is established according to the region in which the locus is positioned after the accelerator opening degree has varied by approximately 10°, for example. This process will be described in detail below.

Figure 11:
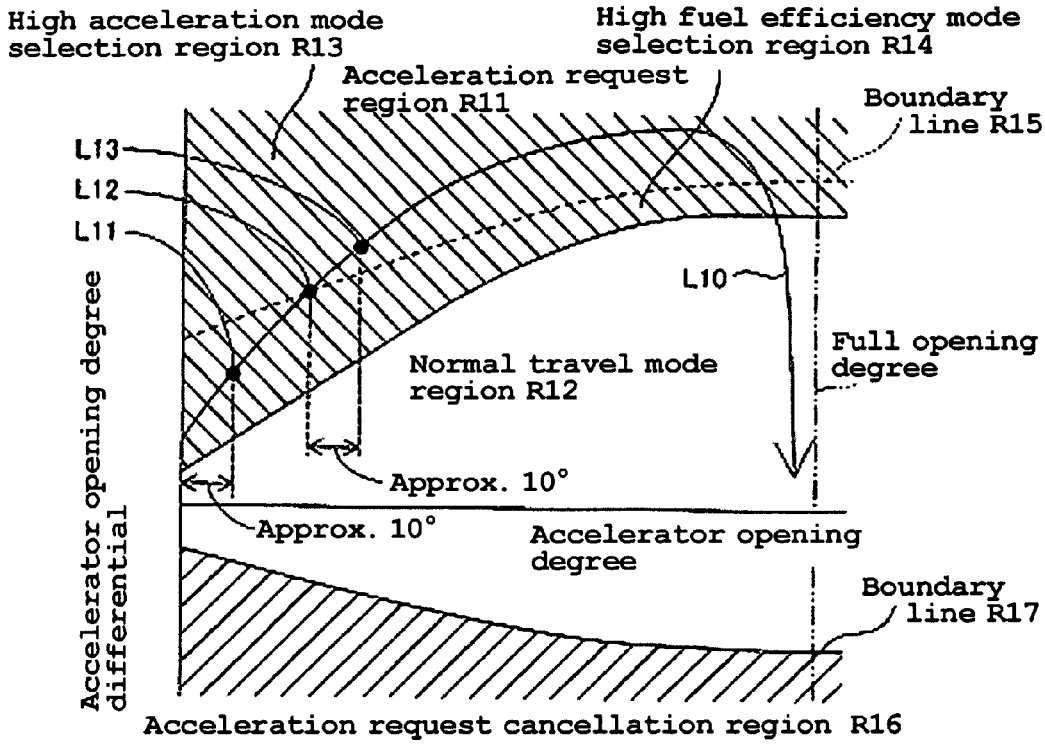
FIG. 11 illustrates a mode selection map of the boat propulsion system in accordance with a preferred embodiment of the present invention.
Figure 12:
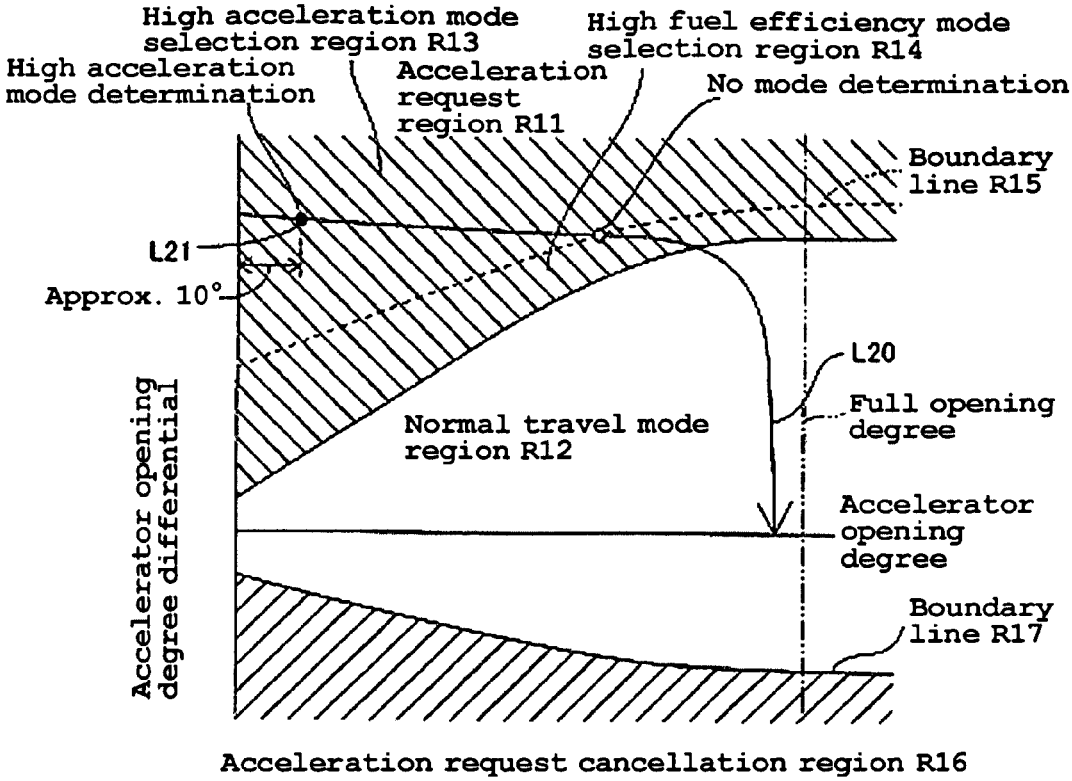
FIG. 12 illustrates a mode selection map of the boat propulsion system in accordance with a preferred embodiment of the present invention.
Figure 13:
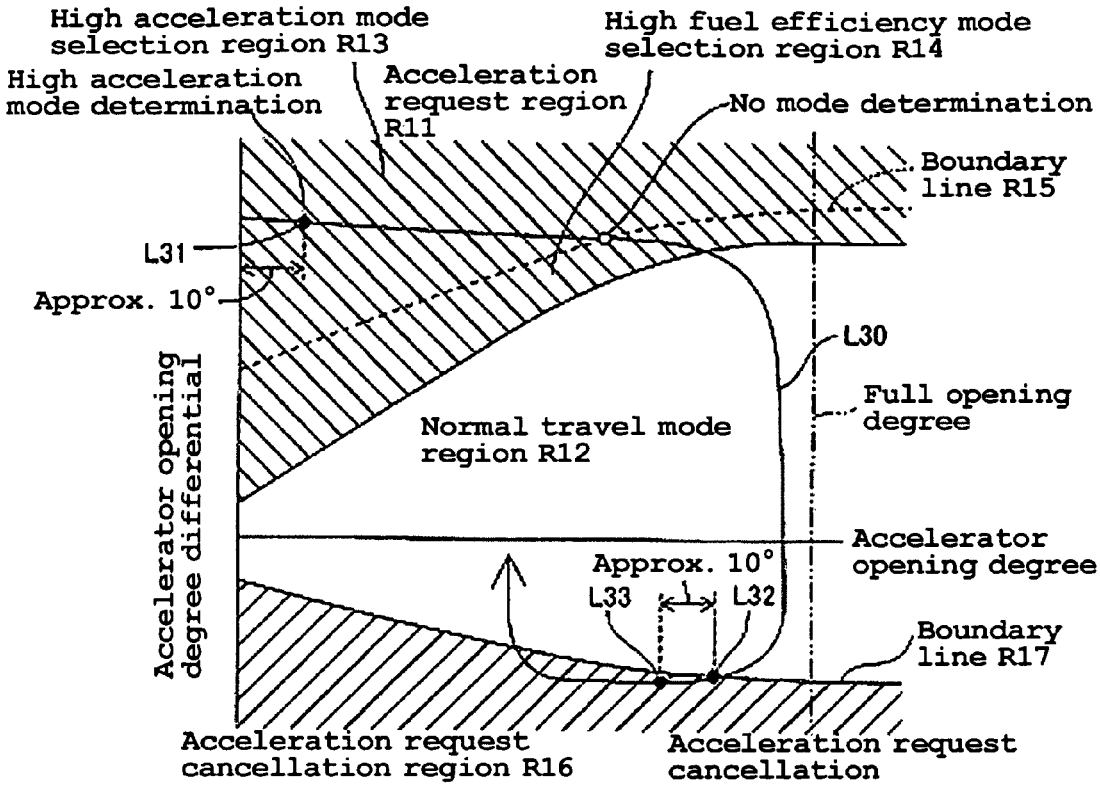
FIG. 13 illustrates a mode selection map of the boat propulsion system in accordance with a preferred embodiment of the present invention.

FIGS. 11 to 13 show an example of mode selection control performed based on the mode selection map in accordance with a preferred embodiment of the present invention. Now, a description will be made of the mode selection control based on the mode selection map in accordance with this preferred embodiment with reference to FIGS. 3 and 10 to 13.

The control section 52 performs a mode determination and a mode selection based on the mode selection map shown in FIG. 10. In the case where the accelerator opening degree and the accelerator opening degree differential vary according to a locus L10 as shown in FIG. 11, for example, a high fuel efficiency mode determination is performed for a period from an accelerator opening degree of 0°, at which the user starts operating the lever 5*a* of the control lever portion 5 after shift-in (after the lever 5*a* is turned to FWD1 in FIG. 3), to an accelerator opening degree of approximately 10°, for example, (timing L11). Since the locus L10 is positioned in the high fuel efficiency mode selection region R14 in the acceleration request region R11 in the period from an accelerator opening degree of 0° to timing L11 on the locus L10, the control section 52 determines that the high fuel efficiency mode determination is established, and selects the high fuel efficiency mode.

After that, when the accelerator opening degree and the accelerator opening degree differential increase (the operation speed of the lever 5*a* of the control lever portion 5 by the user increases) and the locus L10 crosses the boundary line R15, a high acceleration mode determination is performed for a period from timing L12 on the boundary line R15 to timing L13 at which the accelerator opening degree has varied by approximately 10°, for example. Since the locus L10 is positioned in the high acceleration mode selection region R13 in the period from timing L12 to timing L13 on the locus L10, the control section 52 determines that the high acceleration mode determination is established and, switches from the high fuel efficiency mode to the high acceleration mode. In the case where the locus L10 moves out of the high acceleration mode selection region R13 across the boundary line R15 to reach the high fuel efficiency mode selection region R14 during the high acceleration mode determination, the control section 52 determines that the high acceleration mode determination is not established, and maintains the high fuel efficiency mode. Then, when the accelerator opening degree reaches close to the full opening degree, the operation speed of the accelerator opening degree by the user is reduced, and thus the accelerator opening degree differential approaches 0. Therefore, the locus L10 crosses the boundary line R15 toward an accelerator opening degree differential of 0 to reach the normal travel mode region R12. At this time, the control section 52 does not perform a mode determination, and maintains the high acceleration mode.

In this preferred embodiment, in the case where the accelerator opening degree and the accelerator opening degree differential vary according to a locus L20 as shown in FIG. 12, for example, the control section 52 performs a high acceleration mode determination for a period from an accelerator opening degree of 0°, at which the user starts operating the lever 5*a* of the control lever portion 5 after shift-in (after the lever 5*a* is turned to FWD1 in FIG. 3), to an accelerator opening degree of approximately 10°, for example, (timing L21). Since the locus L20 is positioned in the high acceleration mode selection region R13 in the period from an accelerator opening degree of 0° to timing L21 on the locus L20, the control section 52 determines that the high acceleration mode determination is established, and selects the high acceleration mode. After that, when the accelerator opening degree reaches close to the full opening degree, the accelerator opening degree differential approaches 0. Therefore, the locus L20 crosses the boundary line R15 toward an accelerator opening degree differential of 0 to reach the normal travel mode region R12. At this time, the control section 52 does not perform a mode determination, and maintains the high acceleration mode.

In this preferred embodiment, in the case where the accelerator opening degree and the accelerator opening degree differential vary according to a locus L30 as shown in FIG. 13, for example, the control section 52 performs a high acceleration mode determination for a period from an accelerator opening degree of 0°, at which the user starts operating the lever 5*a* of the control lever portion 5 after shift-in (after the lever 5*a* is turned to FWD1 in FIG. 3), to an accelerator opening degree of approximately 10°, for example, (timing L31). Since the locus L30 is positioned in the high acceleration mode selection region R13 in the period from an accelerator opening degree of 0° to timing L31 on the locus L30, the control section 52 determines that the high acceleration mode determination is established, and selects the high acceleration mode. After that, when the accelerator opening degree reaches close to the full opening degree, the accelerator opening degree differential approaches 0. Therefore, the locus L30 crosses the boundary line R15 toward an accelerator opening degree differential of 0 to reach the normal travel mode region R12. At this time, the control section 52 does not perform a mode determination, and maintains the high acceleration mode.

Then, when the user returns the lever 5*a* (see FIG. 3) of the control lever portion 5 (see FIG. 3) in the direction of the arrow BWD (see FIG. 3) at a constant speed, the locus L30 moves in the direction to reduce the accelerator opening degree and the accelerator opening degree differential, moving out of the normal travel mode region R12 across the boundary line R17 to reach the acceleration request cancellation region R16. At this time, the control section 52 performs a mode selection cancellation determination for a period from timing L32, at which the locus L30 crosses the boundary line 17, to timing L33, at which the accelerator opening degree has varied by approximately 10°, for example. Since the locus L30 is positioned in the acceleration request cancellation region R16 in the period from timing L32 to timing L33 on the locus L30, the control section 52 determines that the mode selection cancellation determination is established. Thus, the high acceleration mode is canceled, the normal travel mode is selected, and the speed reduction ratio of the gear shift mechanism 33 is shifted to the high speed reduction ratio. In the case where the locus 30 moves out of the acceleration request cancellation region R16 across the boundary line R17 to reach the normal travel mode region R12 during the mode selection cancellation determination, the control section 52 determines that the mode selection cancellation determination is not established, and maintains the high acceleration mode. In the case where the high fuel efficiency mode is selected when the locus L30 is positioned in the acceleration request cancellation region R16 during the period from timing L32 to timing L33, also, the high fuel efficiency mode is canceled to select the normal travel mode as in the case where the high acceleration mode is selected.

Figure 14:
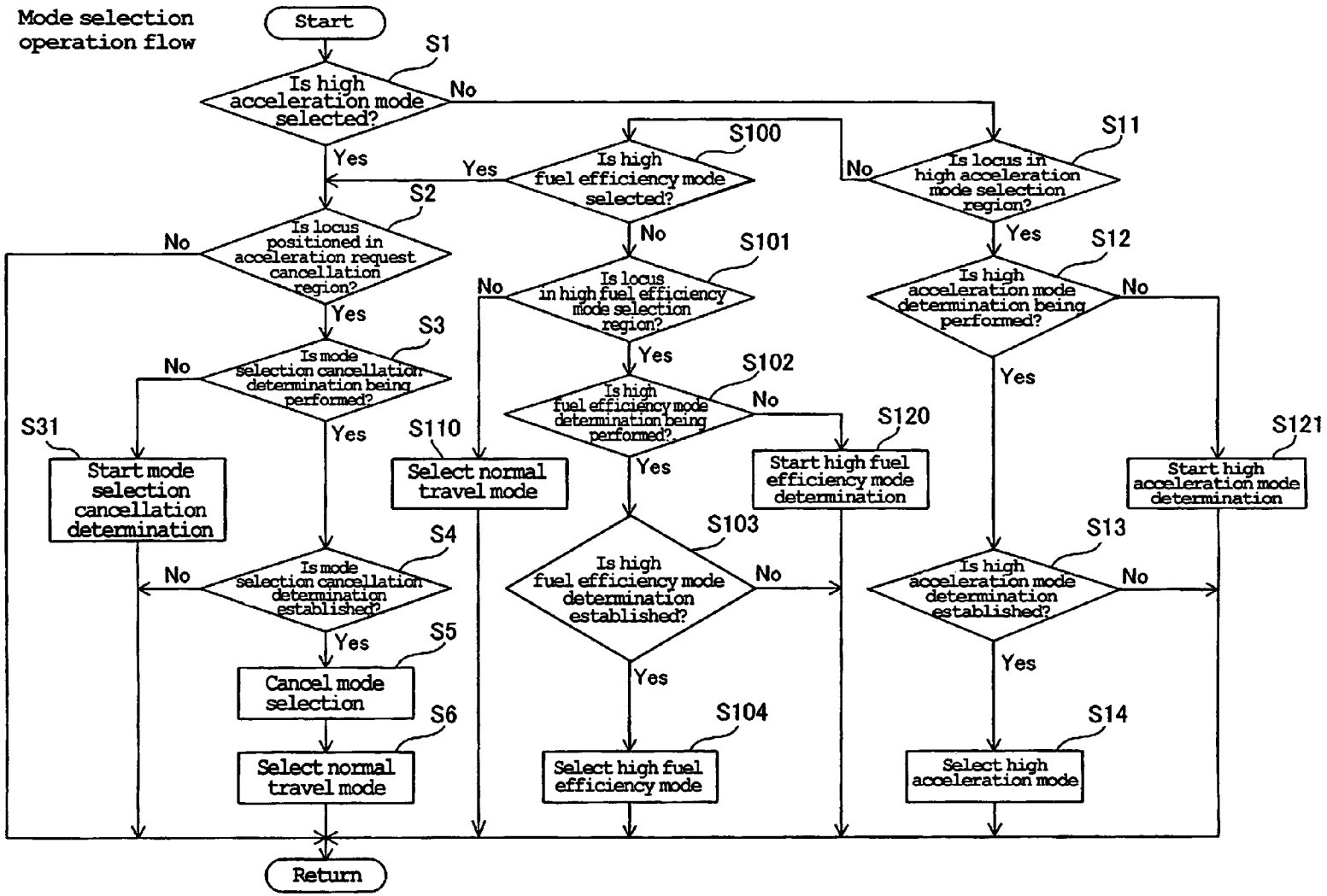
FIG. 14 is a flowchart illustrating the mode selection operation of the boat propulsion system in accordance with a preferred embodiment of the present invention.

FIG. 14 is a flowchart illustrating a mode selection operation of the boat propulsion system in accordance with a preferred embodiment of the present invention. Now, a description will be made of the mode selection operation using the mode selection map in accordance with a preferred embodiment of the present invention with reference to FIGS. 10 to 14.

As shown in FIG. 14, first in step S1, the control section 52 determines whether or not the high acceleration mode is selected. If it is determined that the high acceleration mode is selected, the process proceeds to step S2. If it is determined in step S1 that the high acceleration mode is not selected, the process proceeds to step S11 to be discussed below. Then, in step S2, it is determined whether or not the locus represented by the accelerator opening degree and the accelerator opening degree differential is positioned in the acceleration request cancellation region R16 (see FIG. 10) on the mode selection map. If it is determined that the locus is not positioned in the acceleration request cancellation region R16, the control section 52 performs control so as to maintain the high acceleration mode or the high fuel efficiency mode, and the process is terminated. If it is determined in step S2 that the locus represented by the accelerator opening degree and the accelerator opening degree differential is positioned in the acceleration request cancellation region R16 (see FIG. 10) on the mode selection map, the process proceeds to step S3, where it is determined whether or not a mode selection cancellation determination is being performed for one of the high acceleration mode and the high fuel efficiency mode. If it is determined in step S3 that a mode selection cancellation determination is being performed, the process proceeds to step S4. If it is determined in step S3 that a mode selection cancellation determination is not being performed for one of the high acceleration mode and the high fuel efficiency mode, the process proceeds to step S31, where a mode selection cancellation determination is started. The process is then terminated.

Then, in step S4, it is determined whether or not the mode selection cancellation determination is established. The determination is made based on whether or not the locus represented by the accelerator opening degree and the accelerator opening degree differential is positioned in the acceleration request cancellation region R16 for a period since the locus moves out of the normal travel mode region R12 across the boundary line R17 to reach the acceleration request cancellation region R16 on the mode selection map until the accelerator opening degree has varied by 10°, for example. Then, if it is determined in step S4 that the mode selection cancellation determination is established because it is determined that the locus is positioned in the acceleration request cancellation region R16 in the period since the locus crosses the boundary line R17 until the accelerator opening degree varies by 10°, for example, the process proceeds to step S5, where the selected one of the high acceleration mode and the high fuel efficiency mode is canceled. The process then proceeds to step S6. Then, in step S6, the normal travel mode is selected. The process is then terminated. If it is determined in step S4 that the mode selection cancellation determination is not established because it is determined that the locus is not positioned in the acceleration request cancellation region R16 in the period since the locus crosses the boundary line R17 until the accelerator opening degree varies by 10°, for example, the high acceleration mode is maintained. The process is then terminated.

If the control section 52 determines in step S11 that the high acceleration mode is not selected, the process proceeds to step S11. After that, the control section 52 determines in step S11 whether or not the locus represented by the accelerator opening degree and the accelerator opening degree differential is positioned in the high acceleration mode selection region R13 (see FIG. 10) on the mode selection map. Then, if it is determined in step S11 that the locus is in the high acceleration mode selection region R13 (see FIG. 10), the process proceeds to step S12. If it is determined in step S11 that the locus is not in the high acceleration mode selection region R13 (see FIG. 10), the process proceeds to step S100 to be discussed below. Then, in step S12, it is determined whether or not a high acceleration mode determination is being performed. Then, if it is determined in step S12 that a high acceleration mode determination is being performed, the process proceeds to step S13. If it is determined in step S12 that a high acceleration mode determination is not being performed, the process proceeds to step S121, where a high acceleration mode determination is started. The process is then terminated.

Then, in step S13, it is determined whether or not the high acceleration mode determination is established. The determination is made based on whether or not the locus represented by the accelerator opening degree and the accelerator opening degree differential is positioned in the high acceleration mode selection region R13 for a period since an accelerator opening degree of 0°, or since the locus crosses the boundary line R15 to reach the high acceleration mode selection region R13 on the mode selection map, until the accelerator opening degree varies by 10°, for example. Then, if it is determined in step S13 that the high acceleration mode determination is established because the locus is positioned in the high acceleration mode selection region R13 in the period since an accelerator opening degree of 0°, or since the locus crosses the boundary line R15 to reach the high acceleration mode selection region R13 on the mode selection map, until the accelerator opening degree varies by 10°, for example, the process proceeds to step S14, where the high acceleration mode is selected. If it is determined in step S13 that the high acceleration mode determination is not established because the locus is not positioned in the high acceleration mode selection region R13 in the period since an accelerator opening degree of 0°, or since the locus crosses the boundary line R15 to reach the high acceleration mode selection region R13 on the mode selection map, until the accelerator opening degree varies by 10°, for example, the currently selected mode (one of the high fuel efficiency mode and the normal travel mode) is maintained.

If it is determined in step S11 that the locus represented by the accelerator opening degree and the accelerator opening degree differential is not positioned in the high acceleration mode selection region R13 (see FIG. 10) on the mode selection map, the process proceeds to step S100, where it is determined whether or not the high fuel efficiency mode is selected. Then, if it is determined in step S100 that the high fuel efficiency mode is selected, the process proceeds to step S2. If it is determined in step S100 that the high fuel efficiency mode is not selected, the process proceeds to step S101. Then, in step S101, it is determined whether or not the locus represented by the accelerator opening degree and the accelerator opening degree differential is positioned in the high fuel efficiency mode selection region R14 (see FIG. 10) on the mode selection map. If it is determined that the locus is positioned in the high fuel efficiency mode selection region R14 (see FIG. 10), the process proceeds to step S102. If it is determined in step S101 that the locus is not positioned in the high fuel efficiency mode selection region R14 (see FIG. 10) on the mode selection map, the process proceeds to step S110, where the normal travel mode is selected. The process is then terminated.

Then, in step S102, it is determined whether or not a high fuel efficiency mode determination is being performed. If it is determined that a high fuel efficiency mode determination is being performed, the process proceeds to step S103. If it is determined in S102 that a high fuel efficiency mode determination is not being performed, the process proceeds to step S120, where a high fuel efficiency mode determination is started. The process is then terminated.

Then, in step S103, it is determined whether or not the high fuel efficiency mode determination is established. The determination is made based on whether or not the locus represented by the accelerator opening degree and the accelerator opening degree differential is positioned in the high fuel efficiency mode selection region R14 for a period since an accelerator opening degree of 0°, or since the locus moves out of the normal travel mode region R12 to reach the high fuel efficiency mode selection region R14 on the mode selection map, until the accelerator opening degree varies by about 10°, for example. If it is determined in step S103 that the high fuel efficiency mode determination is established, then in step S104, the high fuel efficiency mode is selected. The process is then terminated. If it is determined in step S103 that the high fuel efficiency mode determination is not established, the locus is determined to be positioned in the normal travel mode region R12. Thus, a mode selection is not performed, and the normal travel mode is maintained.

After the sequence of processing operations are finished, the process returns to step S1 to repeat the processes.

In this preferred embodiment, as described above, in the case where an acceleration command from the user is detected, the control section 52 performs control so as to shift the speed reduction ratio of the gear shift mechanism 33 based on the gear shift control maps MD1 and MD2 each representing a region to shift the speed reduction ratio of the gear shift mechanism 33 using the rotational speed of the engine 31 (the engine speed) and the lever opening degree (the accelerator opening degree) of the lever 5*a* of the control lever portion 5 as parameters. Therefore, the control section 52 can perform control so as to shift the speed reduction ratio according to the acceleration command from the user more appropriately by virtue of using two parameters (the engine speed and the accelerator opening degree), compared to the case where the speed reduction ratio of the gear shift mechanism 33 is shifted based on a certain threshold of one parameter without using the gear shift control maps.

In this preferred embodiment, as described above, the control section 52 selects one of the two gear shift control maps MD1 and MD2 used for shifting the speed reduction ratio according to the accelerator opening degree differential calculated from the lever opening degree (the accelerator opening degree) of the lever 5*a* of the control lever portion 5. Therefore, the control section 52 can easily select the gear shift control map based on the accelerator opening degree differential reflecting the acceleration command from the user.

In this preferred embodiment, as described above, the control section 52 can select the gear shift control map MD2 corresponding to the high fuel efficiency mode or the gear shift control map MD1 corresponding to the high acceleration mode based on the accelerator opening degree and the accelerator opening degree differential. Therefore, the control section 52 can easily perform control of the speed reduction ratio for the high fuel efficiency mode or the high acceleration mode based on the accelerator opening degree and the accelerator opening degree differential reflecting the acceleration command from the user.

In this preferred embodiment, as described above, the control section 52 selects one of the high acceleration mode and the high fuel efficiency mode based on the mode selection map representing respective regions to select the high acceleration mode and the high fuel efficiency mode using the accelerator opening degree and the accelerator opening degree differential, and selects one of the gear shift control maps MD1 and MD2 corresponding to the selected mode. Consequently, the control section 52 can easily select the gear shift control map MD1 corresponding to the high acceleration mode or the gear shift control map MD2 corresponding to the high fuel efficiency mode based on the mode selection map represented by the accelerator opening degree and the accelerator opening degree differential reflecting the acceleration command from the user.

In this preferred embodiment, as described above, the control section 52 selects one of the high acceleration mode and the high fuel efficiency mode in the case where the locus defined on the mode selection map based on the lever opening degree (the accelerator opening degree) of the lever 5*a* of the control lever portion 5 and the accelerator opening degree differential is positioned in the acceleration request region R11 of the mode selection map. Consequently, a mode selection that better matches the acceleration command from the user can be performed since another selection is made between the high acceleration mode and the high fuel efficiency mode in the acceleration request region R11 in which the accelerator opening degree differential reflecting the acceleration command from the user is larger than in the normal travel mode region R12.

In this preferred embodiment, as described above, the control section 52 selects one of the high acceleration mode and the high fuel efficiency mode based on whether or not the locus defined on the mode selection map based on the accelerator opening degree and the accelerator opening degree differential is positioned in the high acceleration mode selection region R13 for a period since the locus moves out of the high fuel efficiency mode selection region R14 across the boundary line R15 until the accelerator opening degree varies approximately 10°, for example. Consequently, a mode selection can be performed in response to only an obvious acceleration request from the user.

In this preferred embodiment, as described above, the control section 52 determines whether or not to cancel the high acceleration mode or the high fuel efficiency mode based on whether or not the locus defined on the mode selection map based on the accelerator opening degree and the accelerator opening degree differential is positioned in the acceleration request cancellation region R16 for a period since the locus moves out of the normal travel mode region R12 across the boundary line R17 to enter the acceleration request cancellation region R16, in which the accelerator opening degree differential is smaller than in the normal travel mode region R12, until the accelerator opening degree varies approximately 10°, for example. Consequently, a mode selection can be canceled in response to only an obvious deceleration request from the user.

In this preferred embodiment, as described above, the control section 52 shifts the speed reduction ratio of the gear shift mechanism 33 to the high speed reduction ratio when canceling the high acceleration mode or the high fuel efficiency mode. Therefore, the speed reduction ratio of the gear shift mechanism can be immediately shifted to the high speed reduction ratio when the acceleration request including the high acceleration mode and the high fuel efficiency mode is canceled.

In this preferred embodiment, as described above, the control section 52 detects an acceleration command from the user according to the differential of the accelerator opening degree, which is the operation amount of the lever 5*a* of the control lever portion 5 by the user. Therefore, there is no need to separately provide a sensor for detecting an acceleration command from the user, thereby preventing an increase in the number of parts. In addition, the control section 52 can determine the presence or absence of an acceleration command from the user by detecting an acceleration command from the user based on the differential of the accelerator opening degree (the lever opening degree) of the lever 5*a* of the control lever portion 5 operated by the user.

In this preferred embodiment, as described above, the mode selection map represents respective regions to select the high fuel efficiency mode and the high acceleration mode using the accelerator opening degree and the accelerator opening degree differential. Therefore, since a mode selection is performed with reference to the accelerator opening degree (the lever opening degree) of the lever 5*a* of the control lever portion 5 by the user and the movement speed (the accelerator opening degree differential) of the lever 5*a* of the control lever portion 5, a mode selection can be performed according to the intention of the user. As a result, the hull 2 can be accelerated according to the intention of the user.

In this preferred embodiment, as described above, the gear shift control map MD1 corresponding to the high acceleration mode is configured such that the shift-down region R1 and the shift-up region R2 thereof are positioned on a side where the rotational speed of the engine 31 (the engine speed) is higher compared to the gear shift control map MD2 corresponding to the high fuel efficiency mode. Consequently, the control section 52 can perform control so as to shift the speed reduction ratio of the gear shift mechanism 33 to the high speed reduction ratio at a higher rotational speed in the case where the high acceleration mode is selected than in the case where the high fuel efficiency mode is selected. As a result, the control section 52 can use the low speed reduction ratio which provides higher acceleration performance for a longer period in the case where the high acceleration mode is selected in the case where the high acceleration mode is selected, thereby accelerating the hull 2 more quickly.

In this preferred embodiment, as described above, the storage section 51 for storing the mode selection map is further provided. Therefore, a boat propulsion system including a mode selection map can be easily obtained.

It should be understood that the preferred embodiments disclosed herein are illustrative in all respects and not restrictive. The scope of the present invention is intended to be defined not by the above description of the preferred embodiments but by the claims, and to include all equivalents and modifications of the claims.

For example, in the above preferred embodiments, the boat propulsion system preferably includes two outboard motors with the engine and the propeller disposed outside the hull. However, the present invention is not limited thereto, and may be applied to other boat propulsion systems including a stern drive with the engine fixed to the hull, an inboard motor with the engine and the propeller fixed to the hull, or the like. The present invention may also be applied to a boat propulsion system including one outboard motor.

In the above preferred embodiments, the boat propulsion system preferably includes outboard motors each provided with two propellers. However, the present invention is not limited thereto, and may be applied to other boat propulsion systems including an outboard motor or the like provided with one or three or more propellers.

In the above preferred embodiments, an acceleration command from the user is preferably detected based on the differential of the lever opening degree of the control lever portion (the accelerator opening degree differential). However, the present invention is not limited thereto, and an acceleration command from the user may be detected by an acceleration sensor. That is, an acceleration command from the user may be determined in the case where the operation speed of the lever of the control lever portion by the user is a certain value or more. In this case, it is possible to detect the acceleration of the hull and hence an acceleration command from the user.

In the above preferred embodiments, an acceleration command from the user is preferably detected based on the differential of the lever opening degree of the control lever portion. However, the present invention is not limited thereto, and an acceleration command from the user may be detected based on the operation speed of the control lever portion by the user.

In the above preferred embodiments, the control section and the ECU are preferably connected through the common LAN cables to enable communication. However, the present invention is not limited thereto, and the control section and the ECU may communicate with each other through wireless communication.

In the above preferred embodiments, the shift position signal is preferably transmitted from the control section to the ECU via only the common LAN cable 7, while the accelerator opening degree signal is preferably transmitted from the control section to the ECU via only the common LAN cable 8. However, the present invention is not limited thereto, and both the shift position signal and the accelerator opening degree signal may be transmitted from the control section to the ECU through the same common LAN cable. Alternatively, the shift position signal may be transmitted from the control section to the ECU via only the common LAN cable 8, while the accelerator opening degree signal may be transmitted from the control section to the ECU via only the common LAN cable 7.

In the above preferred embodiments, the rotational speed of the crankshaft is preferably used as an example of the rotational speed of the engine. However, the present invention is not limited thereto, and the rotational speed of a member (shaft) other than the crankshaft that rotates as the crankshaft rotates in the engine, such as a propeller and an output shaft, may be used as the rotational speed of the engine.

In the above preferred embodiments, an electronic control lever portion that converts the lever opening degree of the lever into an electronic signal and sends it to the ECU is preferably used. However, the present invention is not limited thereto, and a mechanical control lever portion may be used to which a wire is connected so that the lever opening degree of the lever is transmitted to the control section as the amount and direction of movement of the wire corresponding to the amount and direction of operation of the lever. In this case, the amount and direction of movement of the wire is converted into an electronic signal before being sent to the ECU.

In the above preferred embodiments, the storage section 51 built in the control lever portion 5 stores a gear shift control map and a mode selection map, and the control section 52 built in the control lever portion 5 outputs a control signal for shifting the speed reduction ratio to the gear shift mechanism 33. However, the present invention is not limited thereto, and the ECU 34 provided in the outboard motor may store a gear shift control map and a gear shift prohibition map. In this case, the ECU 34 storing the gear shift control map and the gear shift prohibition map may output a control signal.

In the above preferred embodiments, the control section 52 built in the control lever portion 5 preferably detects an acceleration command from the user and defines the "acceleration detection section" according to a preferred embodiment of the present invention. However, the present invention is not limited thereto, and an ECU mounted in the boat propulsion unit such as the outboard motor 3 may detect an acceleration command from the user and may define the "acceleration detection section" of a preferred embodiment of the present invention. In this case, the ECU for controlling the engine of the boat propulsion unit may detect an acceleration command from the user. Alternatively, another ECU separate from the ECU for controlling the engine of the boat propulsion unit may detect an acceleration command from the user.

In the above preferred embodiments, the lower gear shift portion 330 electrically controlled by the ECU 34 preferably switches between forward, neutral, and reverse positions. However, the present invention is not limited thereto, and a mechanical forward/reverse travel switching mechanism including a pair of bevel gears and dog clutches may switch between the forward, neutral, and reverse positions as disclosed in JP-A-Hei 9-263294.

In the above preferred embodiments, the accelerator opening degree and the engine speed are preferably used as the parameters for the gear shift control map. However, the present invention is not limited thereto, and the hull speed and the propeller speed or the throttle opening degree (the opening degree of a throttle valve provided in the air intake passage for the engine) may be used as the parameters for the gear shift control map.

In the above preferred embodiments, one of the high acceleration mode and the high fuel efficiency mode is preferably canceled from the state where the high acceleration mode or the high fuel efficiency mode is selected when the locus represented by the accelerator opening degree and the accelerator opening degree differential enters the acceleration request cancellation region R16 in FIG. 10. However, the present invention is not limited thereto, and the high acceleration mode or the high fuel efficiency mode may be canceled in the case where shift-down is performed based on the gear shift control map of FIG. 8 or 9 and then a shift-up operation is performed while the high acceleration mode or the high fuel efficiency mode is established. Alternatively, a period for which the high acceleration mode or the high fuel efficiency mode is established may be set, and the high acceleration mode or the high fuel efficiency mode may be canceled as the certain period elapses.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A boat propulsion system comprising:

an engine;

a propeller arranged to be driven by the engine;

an acceleration detection section arranged to detect an acceleration command from a user;

a gear shift mechanism arranged to transmit a driving force generated by the engine to the propeller at one of at least a low speed reduction ratio and a high speed reduction ratio; and a control section arranged to perform control so as to shift the speed reduction ratio of the gear shift mechanism based on a gear shift control map in which the acceleration detection section detects an acceleration command from the user; wherein the gear shift control map shifts the speed reduction ratio of the gear shift mechanism based on a plurality of parameters; wherein the gear shift control map includes at least two gear shift control maps, the control section is arranged to select one of the at least two gear shift control maps to shift the speed reduction ratio according to the acceleration command from the user;

the at least two gear shift control maps include a first gear shift control map and a second gear shift control map;

the first gear shift control map corresponds to a high fuel efficiency mode in which the speed reduction ratio of the gear shift mechanism is shifted to a different speed reduction ratio at a predetermined engine speed in which the acceleration detection section detects that the acceleration command from the user is less than a predetermined level;

the second gear shift control map corresponds to a high acceleration mode in which the speed reduction ratio of the gear shift mechanism is shifted to a different speed reduction ratio at an engine speed that is higher than the predetermined engine speed in which the acceleration command from the user is more than the predetermined level; and the control section is arranged to select one of the first gear shift control map and the second gear shift control map based on a lever opening degree of a control lever portion and the acceleration command from the user detected by the acceleration detection section.

2. The boat propulsion system according to claim 1, wherein the control section is arranged to select one of the high acceleration mode and the high fuel efficiency mode based on a mode selection map;

the mode selection map represents respective regions to select the high acceleration mode and the high fuel efficiency mode based on the acceleration command from the user detected by the acceleration detection section and the lever opening degree of the control lever portion; and the control section is arranged to select one of the second gear shift control map and the first gear shift control map corresponding to the selected mode.

3. The boat propulsion system according to claim 2, wherein the mode selection map includes an acceleration request region in which one of the high acceleration mode and the high fuel efficiency mode is selected; and the control section is arranged to select one of the high acceleration mode and the high fuel efficiency mode when a locus defined on the mode selection map based on the acceleration command from the user detected by the acceleration detection section and the lever opening degree of the control lever portion is positioned in the acceleration request region of the mode selection map.

4. The boat propulsion system according to claim 3, wherein the acceleration request region of the mode selection map includes a high acceleration mode selection region in which the high acceleration mode is selected, a high fuel efficiency mode selection region in which the high fuel efficiency mode is selected, and a boundary region provided in the acceleration request region at a boundary between the high acceleration mode selection region and the high fuel efficiency mode selection region; and the control section is arranged to select one of the high acceleration mode and the high fuel efficiency mode based on the acceleration command from the user in a first period when the locus defined on the mode selection map based on the acceleration command from the user and the lever opening degree of the control lever portion moves out of the high fuel efficiency mode selection region across the boundary region.

5. The boat propulsion system according to claim 3, wherein the mode selection map further includes an acceleration request cancellation region in which the one of the high acceleration mode and the high fuel efficiency mode is canceled, and a normal travel mode region provided between the acceleration request region and the acceleration request cancellation region; and the control section is arranged to determine whether or not to cancel the one of the high acceleration mode and the high fuel efficiency mode based on the acceleration command from the user in a second period when the locus defined on the mode selection map based on the acceleration command from the user and the lever opening degree of the control lever portion enters from the normal travel mode region into the acceleration request cancellation region.

6. The boat propulsion system according to claim 5, wherein the control section shifts the speed reduction ratio of the gear shift mechanism to the high speed reduction ratio when canceling the one of the high acceleration mode and the high fuel efficiency mode.

7. The boat propulsion system according to claim 1, wherein the acceleration detection section uses a differential of the lever opening degree of the control lever portion as a value representing the acceleration command from the user, and determines that an acceleration command from the user is detected in the case where the differential of the lever opening degree of the control lever portion is a predetermined value or more and the lever opening degree of the control lever portion has varied to a predetermined value or more.

8. The boat propulsion system according to claim 2, wherein the acceleration detection section is arranged to detect an acceleration command from the user according to the lever opening degree of the control lever portion and a differential of the lever opening degree of the control lever portion; and the mode selection map represents respective regions to select the high fuel efficiency mode and the high acceleration mode according to the lever opening degree of the control lever portion and the differential of the lever opening degree of the control lever portion.

9. The boat propulsion system according to claim 1, wherein the parameters used in the gear shift control map include the engine speed and the lever opening degree of the control lever portion;

each of the region to shift the speed reduction ratio in the first gear shift control map and the region to shift the speed reduction ratio in the second gear shift control map has a first region prescribing the low speed reduction ratio and a second region prescribing the high speed reduction ratio; and the second gear shift control map corresponding to the high acceleration mode is configured such that the first region and the second region thereof are positioned on a side where the engine speed is higher compared to the first gear shift control map corresponding to the high fuel efficiency mode.

10. The boat propulsion system according to claim 1, wherein the acceleration detection section includes an acceleration sensor arranged to detect an acceleration command from the user.

11. The boat propulsion system according to claim 1, wherein the acceleration detection section is arranged to detect an acceleration command from the user based on an operation speed of the control lever portion.

12. The boat propulsion system according to claim 2, further comprising a storage section arranged to store the mode selection map.

* * * * *